US006080259A

United States Patent [19]

Nadeau et al.

[11] Patent Number: 6,080,259

[45] Date of Patent: Jun. 27, 2000

[54] METHOD AND APPARATUS FOR OPERATING A FOLDER-SEALER DEVICE HAVING A POSTAGE DEVICE ASSOCIATED THEREWITH

[75] Inventors: Robert J. Nadeau, Dayton, Ohio; William D. Baker, Cissna Park, Ill.

[73] Assignee: Privatizer Systems, Inc., Dayton, Ohio

[21] Appl. No.: 09/322,146

[22] Filed: May 28, 1999

Related U.S. Application Data

[60] Provisional application No. 60/107,052, Nov. 4, 1998.

[51] Int. Cl.[7] ..... B31F 1/00

[52] U.S. Cl. ..... 156/227; 156/277; 156/384; 156/442; 156/442.1; 156/443; 156/555; 493/421

[58] Field of Search ..... 156/227, 277, 156/384, 387, 441.5, 442, 442.1, 442.2, 443, 555, 582; 493/216, 420, 421

[56] References Cited

U.S. PATENT DOCUMENTS

| | | | |
|---|---|---|---|
| 911,543 | 2/1909 | Owens | 53/117 |
| 1,863,709 | 6/1932 | Beall | 493/419 |
| 3,796,423 | 3/1974 | Shuster | 270/68 A |
| 4,030,960 | 6/1977 | Pratt | 156/555 |
| 4,270,909 | 6/1981 | Ireland | 493/245 |
| 4,288,067 | 9/1981 | Vigano | 493/420 |
| 4,420,147 | 12/1983 | Knox et al. | 270/37 |
| 4,573,672 | 3/1986 | Lehman et al. | 270/45 |
| 4,842,574 | 6/1989 | Noble et al. | 493/421 |
| 4,875,965 | 10/1989 | Marzullo | 156/442.1 |
| 4,900,391 | 2/1990 | Mandel et al. | 156/364 |
| 5,006,195 | 4/1991 | Martin et al. | 156/442.1 |
| 5,048,748 | 9/1991 | Martin et al. | 229/92.1 |
| 5,048,809 | 9/1991 | Tebbe et al. | 270/45 |
| 5,049,227 | 9/1991 | Long et al. | 156/362 |
| 5,098,511 | 3/1992 | Barnes | 156/442.1 |
| 5,114,067 | 5/1992 | Martin et al. | 229/92.1 |
| 5,180,151 | 1/1993 | Branecky et al. | 270/45 |
| 5,192,389 | 3/1993 | Martin | 156/364 |
| 5,194,114 | 3/1993 | Walter | 156/442.1 |
| 5,514,066 | 5/1996 | Monaco | 493/25 |
| 5,527,418 | 6/1996 | Ginsberg | 156/443 |
| 5,934,045 | 8/1999 | Baker et al. | 53/411 |

*Primary Examiner*—James Sells
*Attorney, Agent, or Firm*—Maginot, Addison & Moore

[57] ABSTRACT

A folder-sealer apparatus for folding and sealing a mailer form includes a housing. The apparatus also includes a roller assembly for folding and sealing the mailer form, the roller assembly being positioned within the housing. The apparatus also includes a postage device for securing postage indicia on the mailer form, the postage device being secured within the housing. A method of operating a folder-sealer apparatus is also disclosed.

15 Claims, 18 Drawing Sheets

METHOD AND APPARATUS FOR OPERATING A FOLDER-SEALER DEVICE HAVING A POSTAGE DEVICE ASSOCIATED THEREWITH

CROSS REFERENCE

This application claims the benefit of U.S. Provisional Application Ser. No. 60/107,052, filed Nov. 4, 1998. The disclosure of U.S. Provisional Application Ser. No. 60/107,052 is hereby incorporated by reference.

Cross reference is made to copending U.S. patent applications Ser. No. 09/322,142 filed May 28, 1999, entitled "Apparatus and Method for Folding and Sealing a Mailer Form Having Pressure Sensitive Adhesive Positioned Thereon" by Craig A. Matthews and Mark E. Spitler; Ser. No. 09/322,147 filed May 28, 1999, entitled "Apparatus and Method for Folding and Sealing a Mailer Form Having a Roller with a Deformable Ring Assembly Secured Thereto" by Mark E. Spitler; Ser. No. 09/322,143 filed May 28, 1999, entitled "Apparatus and Method for Biasing a First Roller into Operative Contact with a Second Roller of a Folder-Sealer Device" by Mark E. Spitler; Ser. No. 09/322,144 filed May 28, 1999, entitled "Mailer Form for Use in a Folder-Sealer Device" by William D. Baker and Mark E. Spitler; and Ser. No. 09/322,145 filed May 28, 1999, entitled "Folder-Sealer Device Which is Configured to Receive Mailer Forms from a Number of Different Paper Sources" by William D. Baker and Mark E. Spitler, each of which is assigned to the same assignee as the present invention, and each of which is filed concurrently herewith.

TECHNICAL FIELD OF THE INVENTION

The present invention relates generally to a folder-sealer device, and more particularly to a method and apparatus for operating a folder-sealer device having a postage device associated therewith.

BACKGROUND OF THE INVENTION

Many businesses utilize a folder-sealer device in order to fold and seal sheets of paper such as mailer forms which are to be mailed during normal operations of the business. For example, mailer forms containing advertisements may be printed and then folded and sealed using a heretofore designed folder-sealer device prior to mailing the mailer forms to potential customers. Moreover, confidential information such as an employee pay check or pay stub may be printed on a confidential mailer form and thereafter folded and sealed using a heretofore designed folder-sealer device prior to being mailed to the employee.

Such folder-sealer devices typically place two folds in a mailer form. To place the first fold in the mailer form, the form is fed in from a paper source through a pair of feed rollers into a first chute. The mailer form advances until it contacts a first sheet stop. As the midsection of the mailer form continues to advance, the form buckles away from the first chute. The buckle then comes into contact with, and is fed through, a pair of intermediate rollers which fold the mailer form at the buckle.

To place the second fold in the mailer form, the form is advanced from the intermediate pair of rollers into a second chute. The mailer form advances until the first buckle (having been folded by the intermediate rollers) contacts a second sheet stop. As the midsection of the mailer form continues to advance, the mailer form buckles away from the second chute. The second buckled portion of the mailer form then comes into contact with and is fed through a pair of exit rollers which fold the mailer form at the second buckle. Typically, one of the feed rollers and one of the exit rollers function as the intermediate pair of rollers. Thus, the folder-sealer device requires a total of four rollers to perform the folding function.

In order to seal the folded mailer form, that is, bond the mailer form to itself such that the form cannot readily be unfolded without breaking the bond, the mailer form is subsequently advanced through a set of sealing rollers. The sealing rollers compress the folded mailer form such that an adhesive positioned on the form can seal the folded mailer form. The adhesive may be a heat activated adhesive which requires the mailer form to be heated by a heating element prior to being advanced through the sealing rollers; or, alternately, the adhesive may be a pressure sensitive adhesive which requires that the sealing rollers exert a relatively high pressure on the folded mailer form as it passes through the sealing rollers.

Such heretofore designed folder-sealer devices have a number of drawbacks associated therewith. For example, as described above, heretofore designed folder-sealer devices utilize a first roller assembly for folding the mailer form, and a second, separate roller assembly for sealing the mailer form. Such utilization of separate roller assemblies undesirably increases cost and complexity to the folder-sealer device. Moreover, such utilization of separate roller assemblies undesirably increases the size of the folder-sealer device.

In addition, utilization of separate roller assemblies requires either the use of two separate drive motors (i.e. one for each roller assembly) or a relatively large, expensive single motor with a complex drive system which separates and delivers a portion of the output from the large drive motor to each of the roller assemblies. In either case, (i.e. two separate motors or a relatively large motor and the associated drive components), cost, complexity, and size of the folder-sealer device are undesirably further increased.

Yet further, in the case of use of a heat activated adhesive, a heating unit must be employed to activate the adhesive thereby undesirably further increasing cost and complexity of heretofore designed folder-sealer devices. In the case of use of a pressure sensitive adhesive, heretofore designed folder-sealer devices have included a relatively complex biasing device in order to generate the force necessary to activate the pressure sensitive adhesive.

Moreover, in regard to the use of a pressure sensitive adhesive, the pressure required to activate the adhesive is relatively large thereby necessitating that a relatively large force be maintained between two sealing rollers. Such a relatively large force requirement increases the rolling resistance between the sealing rollers which in turn increases the amount of power required to operate (i.e. rotate) the sealing rollers. Thus, in heretofore designed folder-sealer devices, a relatively large and expensive motor and power supply must be utilized in order to generate the power necessary to operate the sealing rollers.

Another drawback associated with folder-sealer devices which have heretofore been designed is that such devices typically require a large amount of manual feeding during operation thereof thereby undesirably increasing labor costs. In particular, information such as a confidential message and a mailing address is generally printed on the appropriate portion of each of the mailer forms by a printing device such as a laser printer. Thereafter, the printed mailer forms are manually retrieved from the output of the printer by an operator and then manually fed into the folder-sealer device in order to be folded and sealed. In addition to increased labor costs, such manual feeding potentially allows confidential information printed on the mailer forms to be viewed by the operator of the folder-sealer device during creation of the mailer forms.

Yet another drawback associated with folder-sealer devices which have heretofore been designed is that the mailer form generally requires additional processing after being folded and sealed by the device prior to being mailed. For example, subsequent to being folded and sealed, the mailer form generally must be processed through a postage device in order to affix the requisite postage to the form prior to the mailing thereof.

What is needed therefore is a folder-sealer device which overcomes one or more of the above-mentioned drawbacks. What is further needed is a folder-sealer device which is relatively inexpensive to manufacture. What is also needed is a folder-sealer device which utilizes a relatively few number of components. Moreover, what is further needed is a folder-sealer device which is less mechanically complex relative to heretofore designed folder-sealer devices. In addition, what is needed is a folder-sealer device which may be configured to either receive printed mailer forms directly from the output of a printer or from a manual feed tray. Moreover, what is needed is a folder-sealer device which affixes postage on the mailer form. What is further needed is a folder-sealer device which provides enhanced security during creation of a confidential mailer form.

SUMMARY OF THE INVENTION

In accordance with a first embodiment of the present invention, there is provided a folder-sealer apparatus for folding and sealing a mailer form. The apparatus includes a housing. The apparatus also includes a roller assembly for folding and sealing the mailer form, the roller assembly being positioned within the housing. The apparatus also includes a postage device for securing postage indicia on the mailer form, the postage device being secured within the housing.

In accordance with a second embodiment of the present invention, there is provided a method of operating a folder-sealer apparatus. The method includes the step of advancing a mailer form into a print engine of a printing device. The method also includes the step of operating a postage device associated with the folder-sealer apparatus so as to generate an electronic representation of postage indicia. The method further includes the step of transmitting the electronic representation of the postage indicia to the printing device. The method also includes the step of printing the postage indicia on the mailer form with the print engine in response to the transmitting step. Moreover, the method includes the step of advancing the mailer form out of the print engine and into a roller assembly associated with the folder-sealer apparatus.

In accordance with a third embodiment of the present invention, there is provided an apparatus for printing, folding, and sealing a mailer form. The apparatus includes a printing device having a print engine. The apparatus also includes a folder-sealer device having (i) a roller assembly for folding and sealing the mailer form, and (ii) a postage device for generating an electronic representation of postage indicia. The postage device is configured to transmit the electronic representation of the postage indicia to the printing device such that the postage indicia is printed on the mailer form by the print engine when the mailer form is advanced through the print engine.

It is an object of the present invention to provide a new and useful apparatus for folding and sealing a mailer form.

It is another object of the present invention to provide an improved apparatus and method for folding and sealing a mailer form.

It is still another object of the present invention to provide an apparatus for folding and sealing a mailer form which is relatively inexpensive to manufacture.

It is another object of the present invention to provide an apparatus for folding and sealing a mailer form which utilizes a relatively few number of components.

It is moreover an object of the present invention to provide an apparatus for folding and sealing a mailer form which is less mechanically complex relative to heretofore designed folder-sealer devices.

It is a further object of the present invention to provide an apparatus for folding and sealing a mailer form which is flexible enough to receive input from different paper sources.

It is a yet further object of the present invention to provide an apparatus for folding and sealing a mailer form which eliminates the need for subsequent processing of a mailer form by a postage device.

It is moreover an object of the present invention to provide a folder-sealer device which provides enhanced security during creation of a confidential mailer form.

The above and other objects, features, and advantages of the present invention will become apparent from the following description and attached drawings.

DETAILED DESCRIPTION OF THE INVENTION

Figure 1:
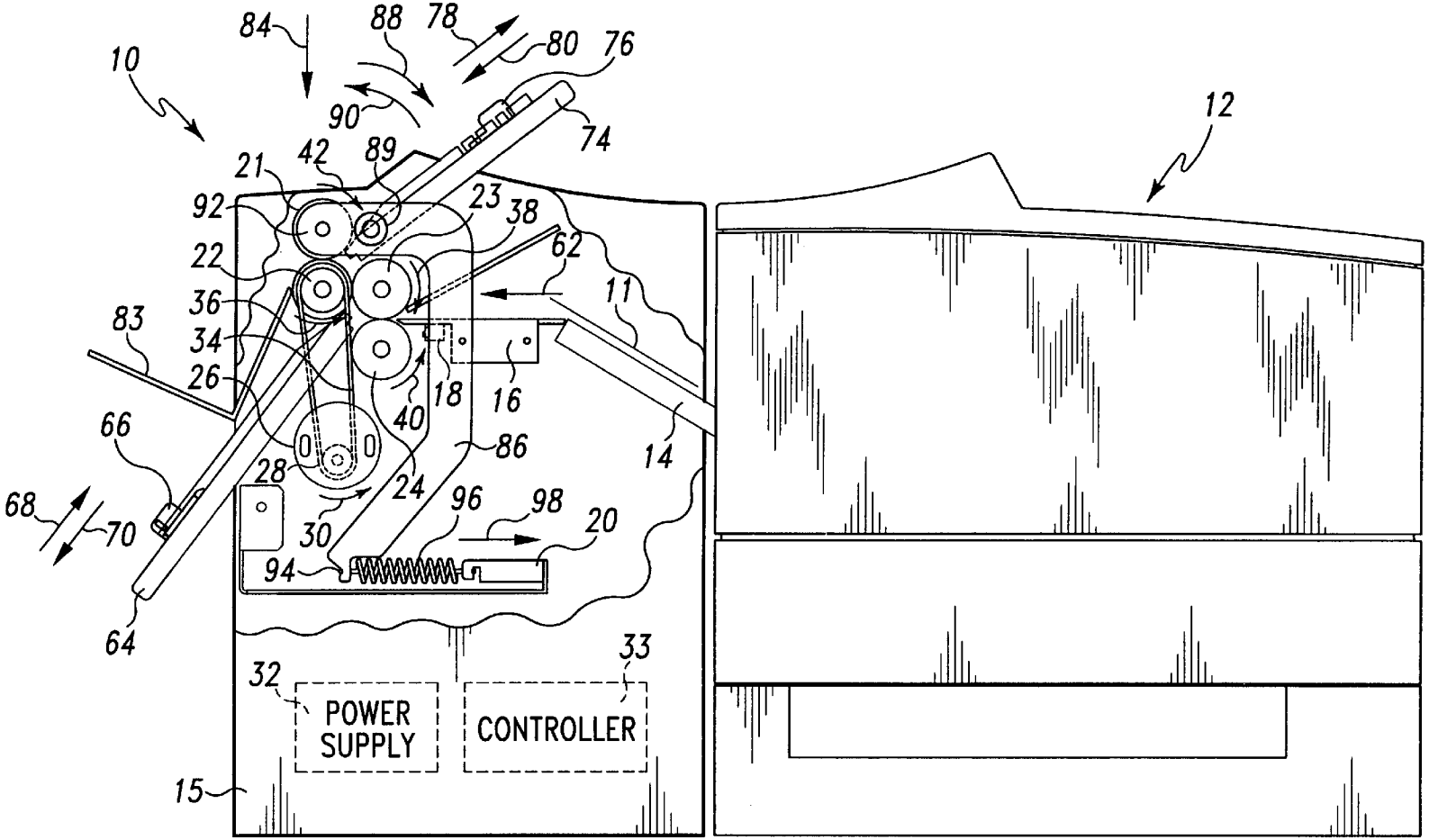
FIG. 1 is a partially cut away side elevation view of a folder-sealer device which incorporates the features of the present invention therein, note that the folder-sealer device is shown secured to a laser printer.

While the invention is susceptible to various modifications and alternative forms, a specific embodiment thereof has been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Referring now to FIG. 1, there is shown the folder-sealer device 10 of the present invention. The folder-sealer device 10 is configured to receive a sheet of paper such as a mailer form 11 which exits an output mechanism of a printing device such as a laser printer 12. In particular, the mailer form 11 exits the laser printer 12 via a printer discharge tray 14 after the laser printer 12 has printed information on the mailer form 11. As shown in FIG. 1, the discharge tray is positioned within a housing 15 of the folder-sealer device 10. From the discharge tray 14, the mailer form 11 advances to an input guide 16. The input guide 16 is secured to a frame 20 (see FIG. 2) which supports the various components of the folder-sealer device 10. The input guide 16 is substantially V-shaped and is operable to position and align the mailer form 11 before the mailer form 11 is folded and sealed. A photo sensor 18 is positioned proximate the input guide 16 and is operable to generate a sheet position signal when the mailer form 11 is positioned above the photo sensor 18 in the input guide 16.

The folder-sealer device 10 further includes an electric motor 26. The electric motor 26 includes a drive wheel 28 that rotates in the general direction of arrow 30 upon receipt of a motor control signal. The drive wheel 28 advances a drive belt 34 in the general direction of arrow 30. Upon receipt of the motor control signal, power is supplied to the electric motor 26 by a power supply 32 so as to cause the drive wheel 28 and the drive belt 34 to advance in the general direction of arrow 30.

The folder-sealer device 10 further includes a controller 33 which is operative to receive sheet position signals from the photo sensor 18 and generate motor control signals in response thereto. In particular, upon receipt of the sheet position signal, the controller 33 determines the timing and duration of the motor control signal which controls the operation of the electric motor 26. Moreover, as shall be discussed below in more detail, the controller 33 communicates with a computing device 130, such as a personal computer (PC), in order to coordinate the operation of a number of the components associated with the folder-sealer device 10 with the operation of the laser printer 12.

The folder-sealer device 10 further includes a number of rollers 21, 22, 23, and 24. Each of the rollers 21, 22, 23, and 24 is rotatably coupled to the frame 20. As the drive belt 34 advances in the general direction of arrow 30, the drive belt 34 drives the roller 22 so as to cause the roller 22 to rotate in the general direction of arrow 36. The roller 22 and the roller 23 are coupled to each other by a first pair of drive gears (not shown) such that rotation of the roller 22 in the general direction of arrow 36 causes the roller 23 to rotate in the general direction of arrow 38. Similarly, the roller 23 and the roller 24 are coupled to each other by a second pair of drive gears (not shown) such that rotation of the roller 23 in the general direction of arrow 38 causes the roller 24 to rotate in the general direction of arrow 40. Moreover, the roller 22 and the roller 21 are coupled to each other by a third pair of drive gears (not shown) such that rotation of the roller 22 in the general direction of arrow 36 causes the roller 21 to rotate in the general direction of arrow 42.

Figure 3:
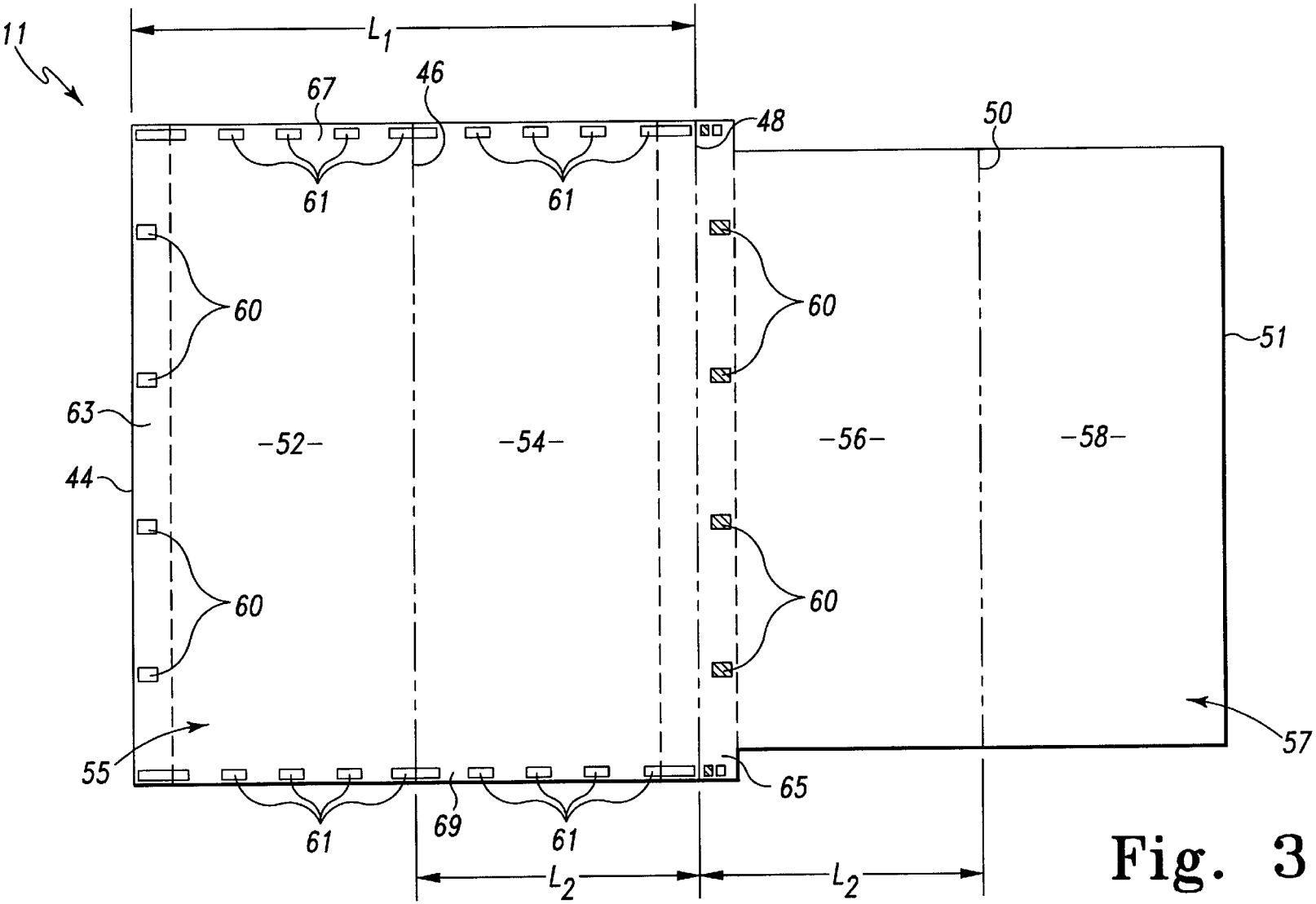
FIG. 3 is a top elevational view of a mailer form which is folded and sealed in the folder-sealer device of FIG. 1.

Referring now to FIG. 3, there is shown the mailer form 11 in greater detail. The mailer form 11 is preferably configured as a confidential mailer form. In particular, the mailer form may be utilized to communicate confidential information to the recipient of the mailer form 11. For example, the mailer form 11 may be utilized to communicate confidential information such as payroll or tax information to an employee. Alternatively, the mailer form 11 may also be utilized to communicate advertisements and the like to potential customers of a business organization.

The mailer form 11 includes a leading edge 44, a first perforated fold line 46, a second perforated fold line 48, a third perforated fold line 50, and a trailing edge 51. Each of the perforated lines 46, 48, 50 is preferably constructed with the same perforation or cut pattern in order to ease manufacture of the mailer form 11. The portion of the mailer form 11 between the leading edge 44 and the first perforated line 46 defines a first sheet segment 52. The portion of the mailer form 11 between the first perforated line 46 and the second perforated line 48 defines a second sheet segment 54. The portion of the mailer form 11 between the second perforated line 48 and the third perforated line 50 defines a third sheet segment 56. The portion of the mailer form 11 between the third perforated line 50 and the trailing edge 51 defines a fourth sheet segment 58. Collectively, the first sheet segment 52 and the second sheet segment 54 define an envelope segment 55, whereas the third sheet segment 56 and the fourth sheet segment 58 collectively define a message segment 57. As shall be discussed below in more detail, a message such as a confidential message may be printed on the message segment 57. Thereafter, the folder-sealer device 10 may be utilized to fold and seal the message segment 57 within the envelope segment 55.

The mailer form 11 further includes a number of patches 60 and 61 having a pressure sensitive adhesive disposed therein. The pressure sensitive adhesive disposed in the patches 60 and 61 may be any commercially available pressure activated adhesive. One such pressure activated adhesive which may be used with the present invention is a pressure activated coadhesive which is available from Moore North America of Toronto, Canada as either standard or enhanced chemistry pressure activated coadhesive.

As shown in FIG. 3, the adhesive patches 60 are located within opposite transverse edge portions 63, 65 of one another, whereas the adhesive patches 61 are located in opposite lateral edge portions 67, 69 of one another. As indicated by angled lines in FIG. 3, certain of the adhesive patches 60 located in the transverse edge portion 65 are positioned on a backside of the mailer form 11. As shall be discussed below in greater detail, such positioning allows the adhesive patches 60 located in the transverse edge portion 65 to align with (and hence be pressed into contact with) the adhesive patches 60 located in the transverse edge portion 63. Moreover, during folding and sealing of the mailer form 11, the adhesive patches 61 located in the lateral edge portion 67 of first sheet segment 52 align with (and hence are pressed into contact with) the adhesive patches 61 located in the lateral edge portion 67 of the second sheet segment 54. Similarly, during folding and sealing of the mailer form 11, the adhesive patches 61 located in the lateral edge portion 69 of first sheet segment 52 align with (and hence are pressed into contact with) the adhesive patches 61 located in the lateral edge portion 69 of the second sheet segment 54.

Figure 4A:
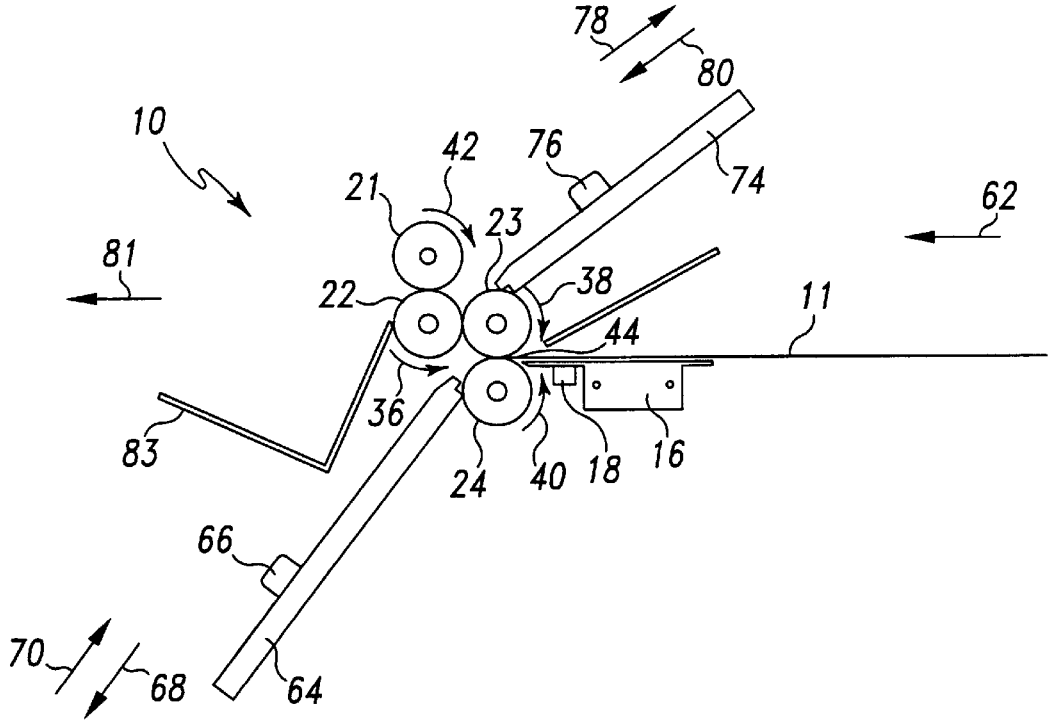
FIG. 4A is a schematic view of the folder-sealer device showing the mailer form being advanced between the first feed roller and the second feed roller.
Figure 4B:
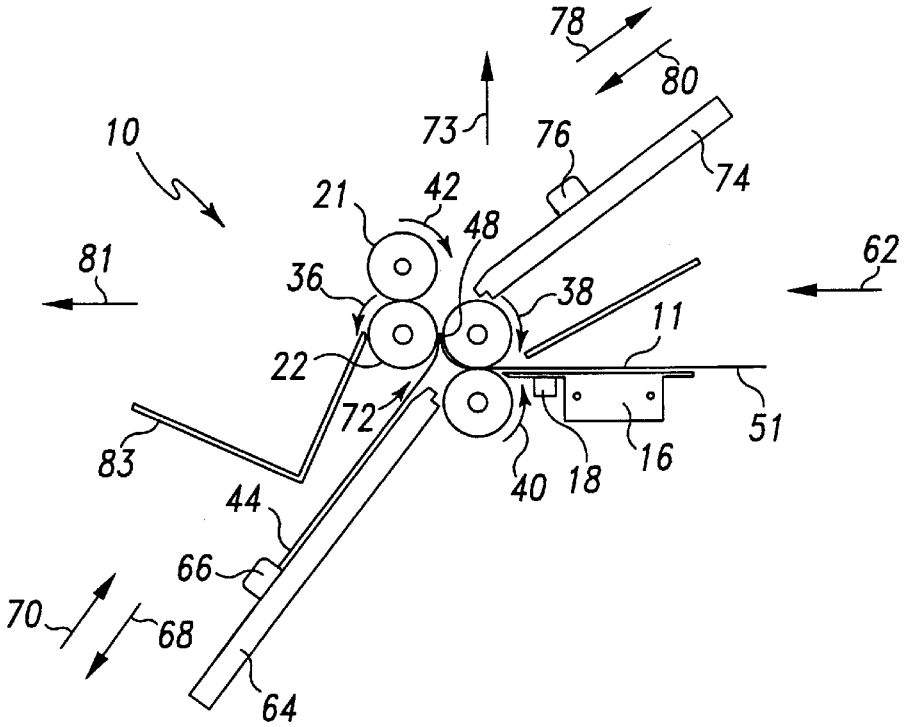
FIG. 4B is a view similar to FIG. 4A, but showing a first fold being formed in the mailer form.
Figure 4C:
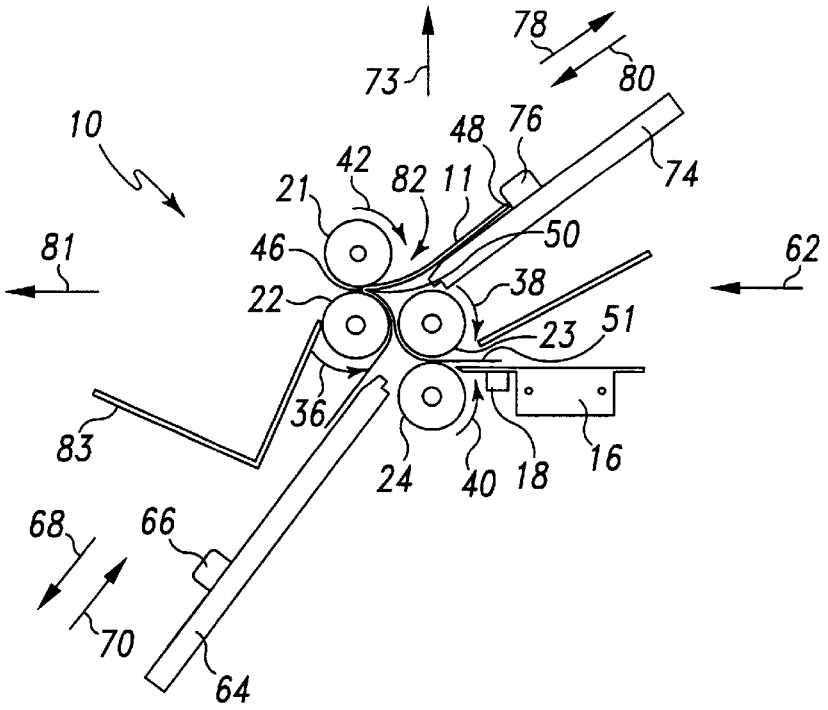
FIG. 4C is a view similar to FIG. 4A, but showing a second fold being formed in the mailer form and the folded form being sealed.
Figure 4D:
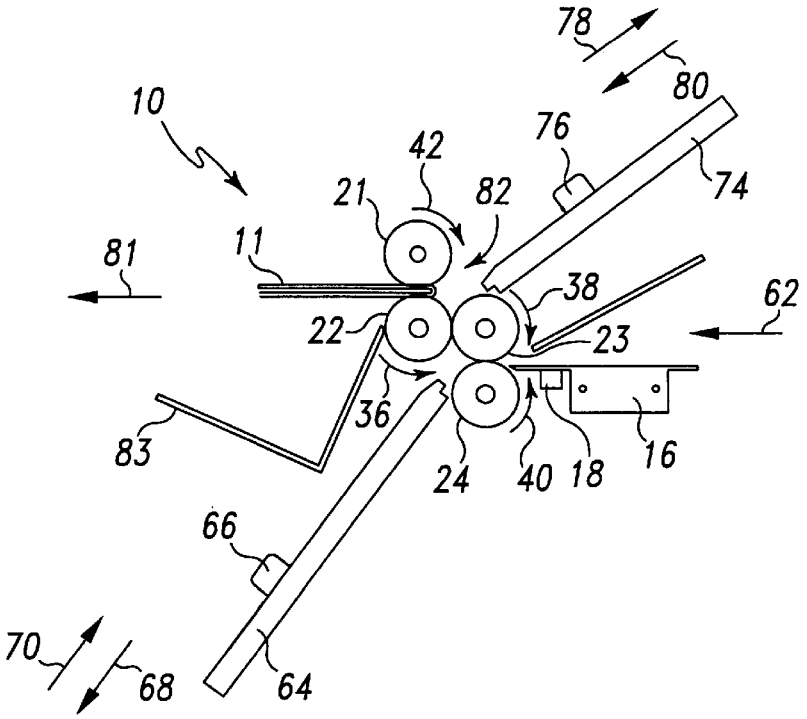
FIG. 4D. is a view similar to FIG. 4C, but further showing the second fold being formed and the folded form being sealed.
Figure 4E:
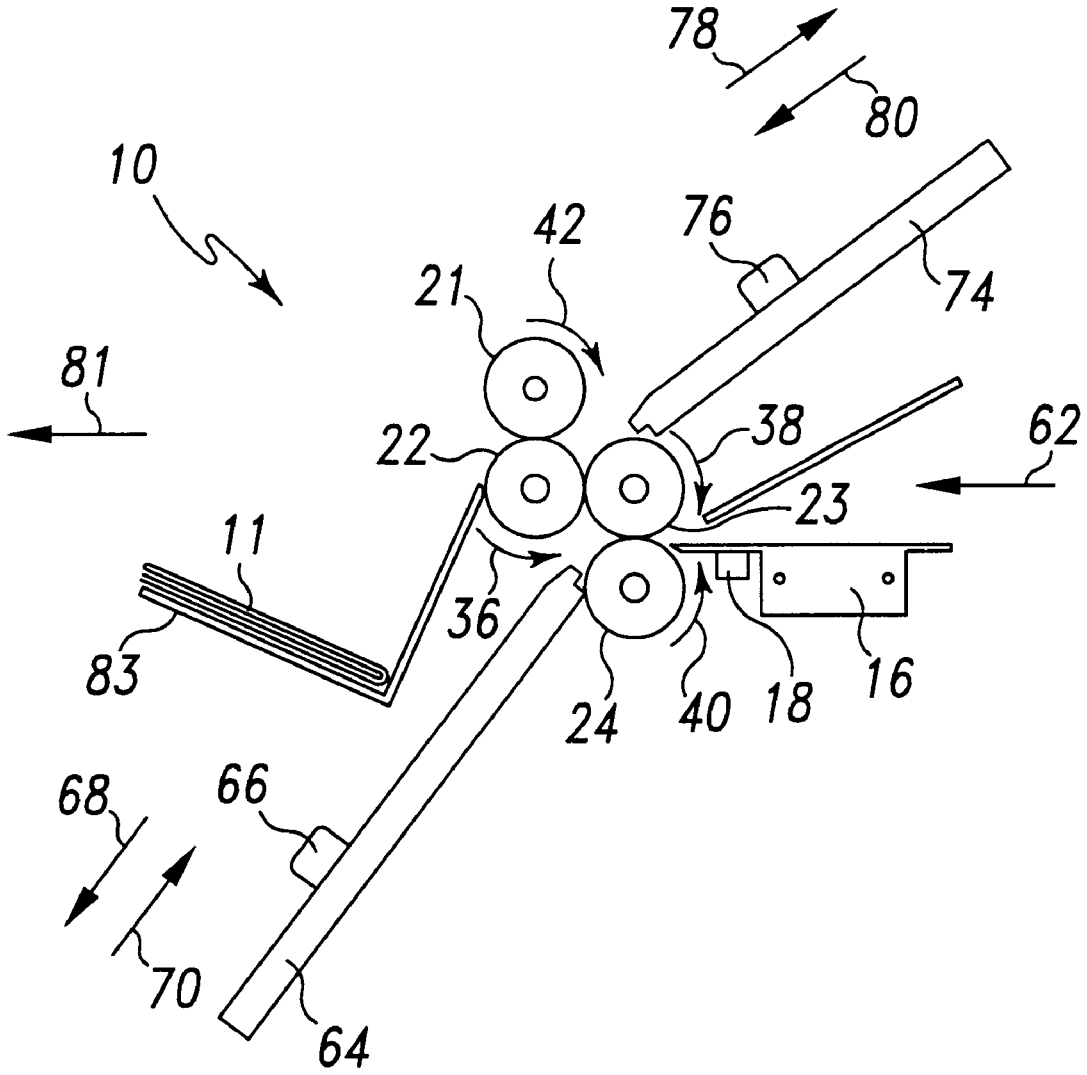
FIG. 4E is a view similar to FIG. 4A, but showing the completed folded and sealed mailer form in the output tray of the folder-sealer device.
Figure 5A:
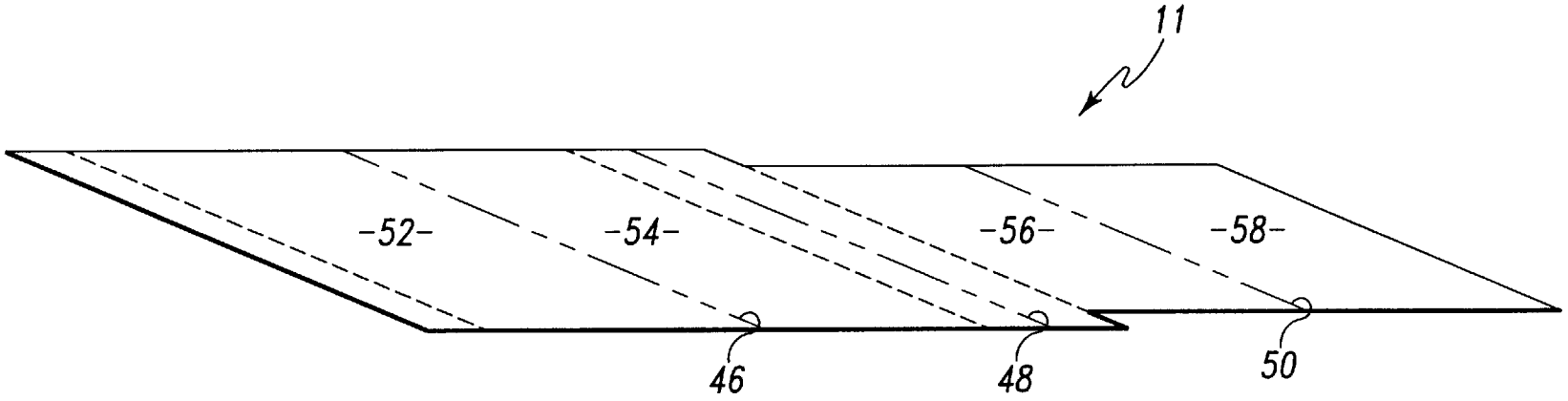
FIGS. 5A–5E show the mailer form in various orientations during a folding and sealing operation performed by the folder-sealer device of FIG. 1.

Referring now to FIGS. 4A–4E and 5A–5E, there is shown the mailer form 11 in various stages of a folding and sealing operation. In particular, as shown in FIGS. 4A and 5A, the mailer form 11 is generally flat in orientation when the mailer form is positioned on the input guide 16 during advancement thereof into the folder-sealer device 10 from the laser printer 12. The mailer form 11 is advanced in the general direction of arrow 62 of FIG. 3A by the output mechanism (e.g. an output sheet transport system) of the laser printer 12. As the mailer form 11 advances in the general direction of arrow 62, the mailer form 11 passes over the photo sensor 18 which generates a paper position signal. Upon receipt of the paper position signal, the controller 33 delays generating a motor control signal for a predetermined time period. Such a delay allows the output mechanism of the laser printer 12 sufficient time to advance the mailer form 11 into the nip defined by roller 23 and the roller 24 so as to assure that the mailer form 11 is squared against the roller 23 and roller 24 prior to being advanced between the roller 23 and the roller 24. After the predetermined delay, the controller 33 generates a motor control signal which activates the motor 26 thereby causing the roller 23 to rotate in the general direction of arrow 38 and causing the roller 24 to rotate in the general direction of arrow 40. The roller 23 and the roller 24 are in operative contact with each other. What is meant herein as operative contact is that a first roller (e.g. the roller 23) and a second roller (e.g. the roller 24) cooperate with one another so as to advance the mailer form 11 therebetween. In addition, operative contact means that the force being exerted by the rollers (e.g. the rollers 23, 24) which act on one another is transmitted through the mailer form 11 and any object, such as the adhesive patches 60, 61, disposed on the mailer form 11. Thus, as the roller 23 rotates in the general direction of arrow 38 and the roller 24 rotates in the general direction of arrow 40, the mailer form 11 is advanced between the roller 23 and roller 24 in the general direction of arrow 62. It should be noted that the controller 33 preferably operates the motor 26 such that the mailer form 11 is initially advanced a short distance by the rollers 23, 24 and thereafter halted for a brief, predetermined period of time. Such a brief halt in advancement of the mailer form 11 allows the trailing edge 51 of the mailer form 11 to fully exit the output mechanism of the printer 12 prior to further advancement of the mailer form 11 through the folder-sealer device 10.

As shown in FIG. 4B, the folder-sealer device 10 further includes a first chute 64 positioned to receive the mailer form 11 after it exits the roller 23 and the roller 24. A first sheet stop 66 is positioned to halt advancement of the mailer form 11 as the mailer form in advanced in the general direction of arrow 68. In particular, once the leading edge 44 of the mailer form 11 comes into contact with the first sheet stop 66, further advancement of the leading edge 44 in the general direction of arrow 68 is prevented. As the roller 23 and the roller 24 continue to urge the mailer form 11 in the general direction of arrow 62, the mailer form 11 begins to buckle at the second perforated line 48, as shown in FIGS. 4B and 5B.

As the roller 23 and the roller 24 continue to rotate, the buckle at the second perforated line 48 advances in the general direction of arrow 73 toward a nip 72 formed by the roller 22 and the roller 23. The roller 22 and the roller 23 are in operative contact with each other such that as the roller 22 rotates in the general direction of arrow 36 and the roller 23 rotates in the general direction of arrow 38, the buckle at the second perforated line 48 is advanced between the roller 22 and the roller 23 in the general direction of arrow 73 so as to create a first fold in the mailer form 11 (see FIG. 5B).

Figure 5B:
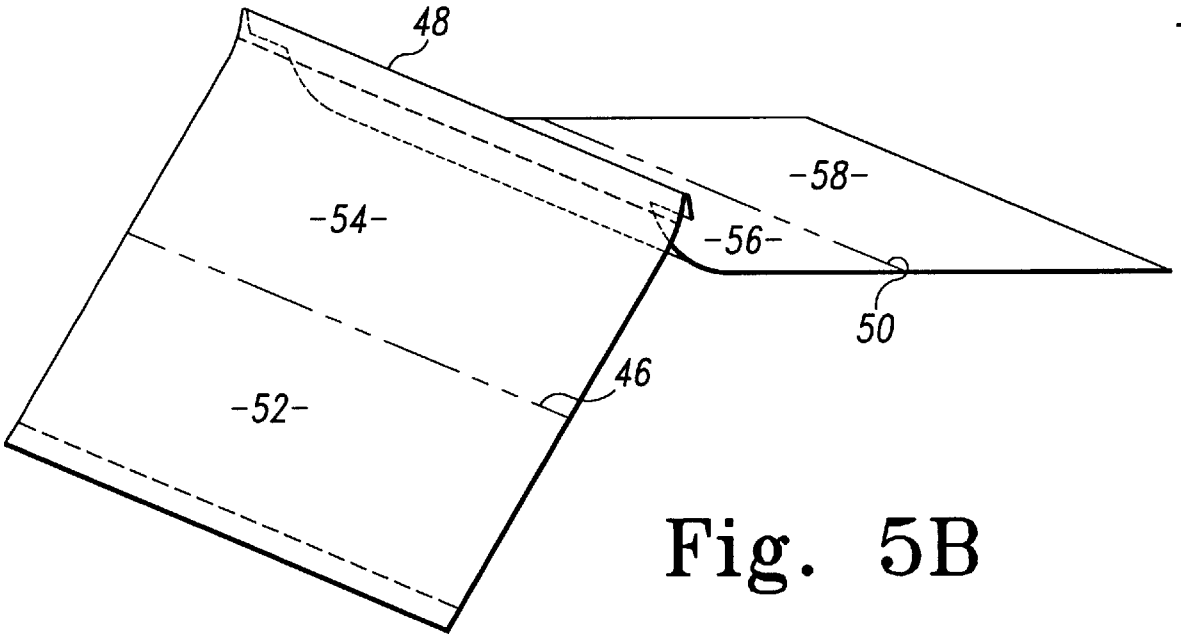
Figure 5C:
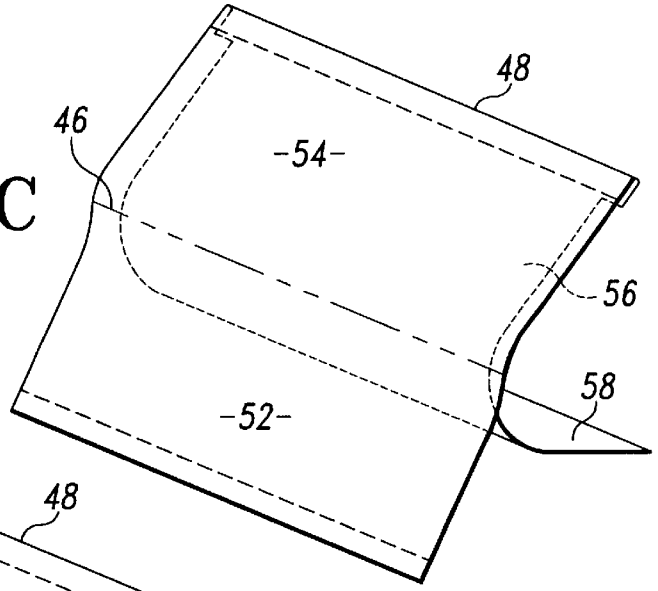

A distance L1 (shown in FIG. 3) between the leading edge 44 and the second perforated line 48 corresponds to the distance between the first stop 66 and the nip 72 defined by the roller 22 and the roller 23 in order to create the aforementioned fold in the mailer form 11 which is shown in FIGS. 4B and 5B. It should be appreciated that the first stop 66 is adjustable in the general direction of arrows 68 and 70 in order to allow mailer forms of various configurations and fold locations to be folded and sealed with the folder-sealer device 10.

As shown in FIGS. 4C and 4D, the folder-sealer device 10 further includes a second chute 74 positioned to receive the mailer form 11 after it exits the roller 22 and the roller 23. A second sheet stop 76 is positioned to halt advancement of the mailer form 11 in the general direction of arrow 78. In particular, after the fold at the second perforated line 48 of the mailer form 11 comes into contact with the second sheet stop 76 (see FIGS. 4C and 5C), thereby preventing additional advancement of the mailer form 11 in the general direction of arrow 78. As the roller 22 and the roller 23 continue to urge the mailer form 11 in the general direction of arrow 78, the mailer form 11 begins to buckle in two locations. In particular, the mailer form 11 buckles along the first perforated line 46, and also along the third perforated line 50 (see FIGS. 3, 4C, and 5D).

The buckle at the first perforated line 46 and the buckle at the third perforated line 50 are then contemporaneously advanced through a nip 82 formed by the roller 21 and the roller 22. It should be appreciated that the roller 21 and the roller 22 are in operative contact with each other such that as the roller 21 rotates in the general direction of arrow 42 and the roller 22 rotates in the general direction of arrow 36, the buckle at the first perforated line 46 and the buckle at the third perforated line 50 contemporaneously advance between the roller 21 and the roller 22 in the general direction of arrow 81 so as to create a second fold in the mailer form 11 at the first perforated line 46 and the third perforated line 50 (see FIGS. 4C and 5D).

Figure 5D:
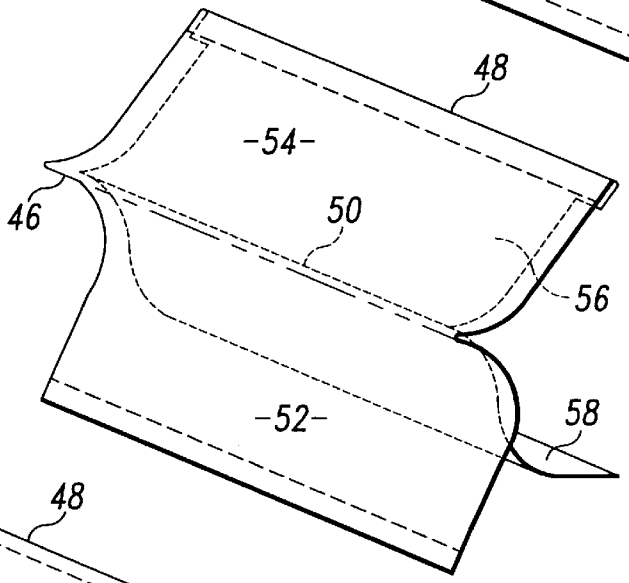
Figure 5E:
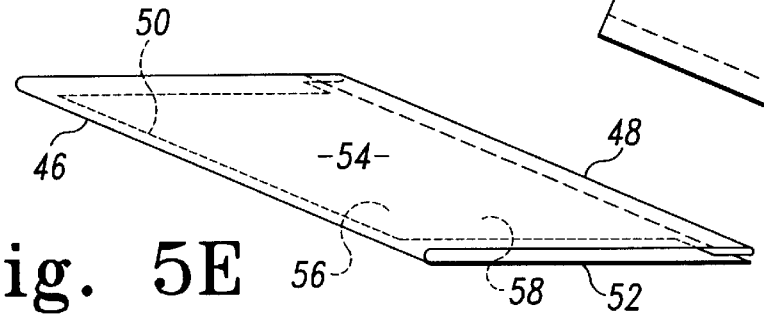

A distance $L_2$ (shown in FIG. 3) between (1) the first perforated line 46 and the second perforated line 48, and (2)

the second perforated line 48 and the third perforated line 50 corresponds the distance between the second sheet stop 76 and the nip 82 defined by the roller 21 and the roller 22 in order to create the aforementioned fold in the mailer form 11 which is shown in FIGS. 4C and 5D. It should be appreciated that the second sheet stop 76 is adjustable in the general direction of arrows 78 and 80 in order to allow mailer forms of various configurations and fold locations to be folded and sealed with the folder-sealer device 10.

As shown in FIG. 4C, once the trailing edge 51 of the mailer form 11 advances in the general direction of arrow 62 to a location beyond the photo sensor 18, the photo sensor 18 ceases to generate the paper position signal. In response to absence of the paper position signal, the controller 33 continues operation of the roller motor 26 for a predetermined time period. Such continued operation of the motor 26 allows sufficient time for the folded and sealed mailer form 11 (see FIG. 5E) to pass through the roller 21 and the roller 22 (see FIG. 4D) to an output tray or bin 83 which holds the finished folded mailer form 11 (see FIG. 4E). After continuing to operate the motor 26 for the predetermined time period, the controller 33 ceases to generate the motor control signal which causes the motor 26 to cease to rotate the drive wheel 28 thereby ceasing rotation of the rollers 21, 22, 23, and 24 in ample time to render the folder-sealer device 10 ready to accept the leading edge 44 of a subsequent mailer form 11 into the nip of the rollers 23, 24.

Figure 2:
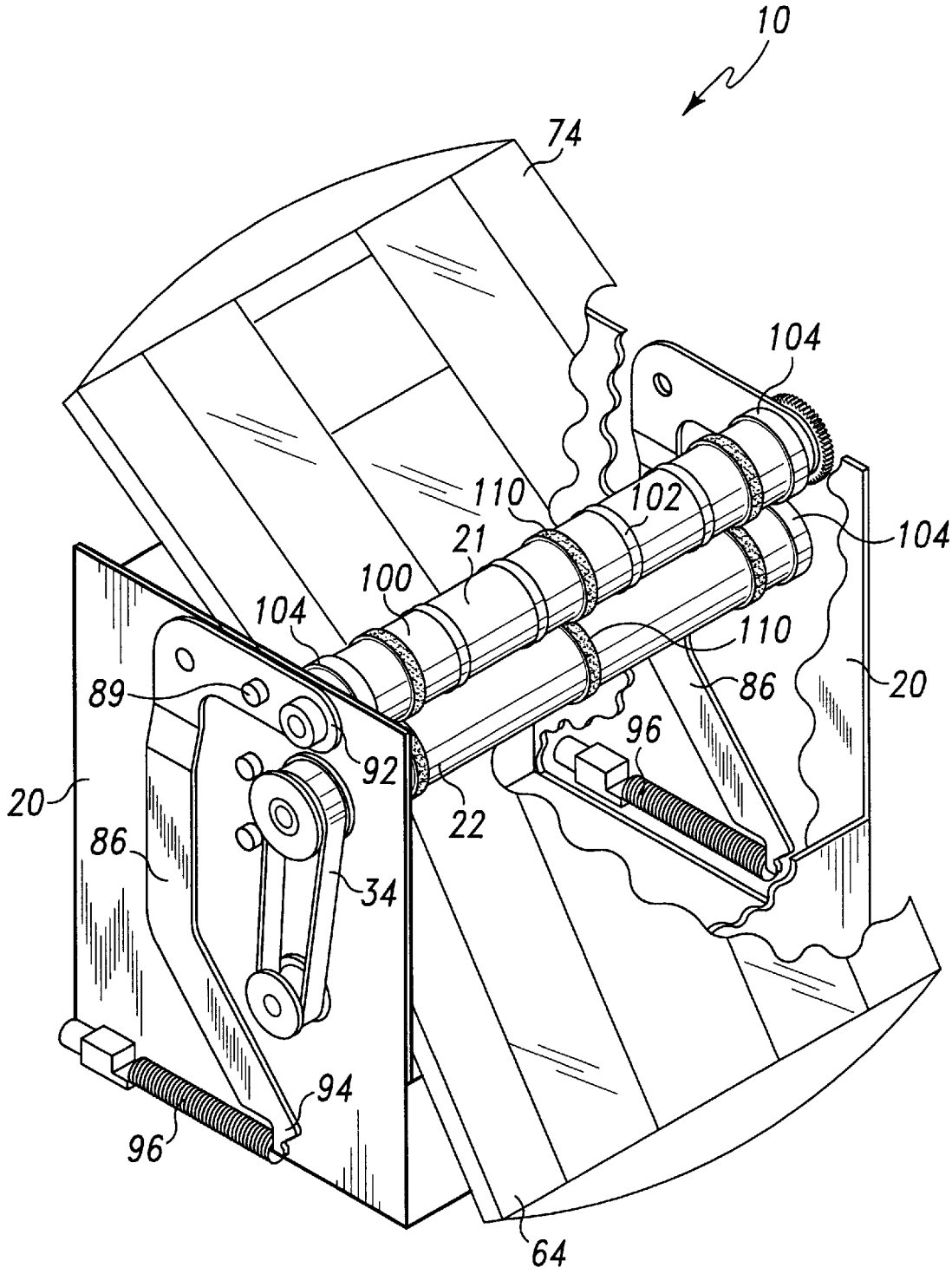
FIG. 2 is perspective view of the folder-sealer device of FIG. 1, note that the housing has been removed for clarity of description.

In order to seal the mailer form 11 as the second fold is placed in the mailer form 11 (i.e. as the mailing form is advanced through the nip 82 of the rollers 21 and 22), a sealing force or pressure on the order of 350 pounds per linear inch, is exerted on the adhesive patches 60 and 61 in order to activate the pressure sensitive adhesive. To supply such a sealing pressure, the roller 21 is biased downwardly toward the roller 22 in the general direction of arrow 84 (see FIG. 1). As shown in FIGS. 1 and 2, in order to supply the necessary biasing force for biasing the roller 21 downwardly, a pair of biasing lever arms 86 are pivotally coupled to the frame 20 by pivot pins 89 such that the lever arms 86 can pivot in the general direction of arrows 88 and 90 of FIG. 1 about the pins 89.

As shown in FIGS. 1 and 2, the roller 21 is rotatably secured to a first end 92 of the lever arms 86, whereas a second end 94 of the lever arms 86 is secured to a spring 96. The spring 96 is interposed between the second end 94 of the lever arm 86 and the frame 20. The spring 96 supplies a spring force to the lever arm 86 in the general direction of arrow 98 which causes the lever arm 86 to pivot about the pin 89 in the general direction of arrow 90. As the lever arm 86 pivots in the general direction of arrow 90, the first end 92 and the roller 21 is urged in the general direction of arrow 84 toward the roller 22 thereby generating a sealing force which is exerted on the adhesive patches 60, 61 when the mailer form 11 is advanced between the roller 21 and the roller 22. It should be appreciated that lever arm 86 is configured to provide approximately a nine to one mechanical advantage to the spring 96. Therefore, the biasing force of the roller 21 acting on the roller 22 in the general direction of arrow 84 is approximately nine times the force of the spring 96 acting in the general direction of arrow 98.

Figure 6:
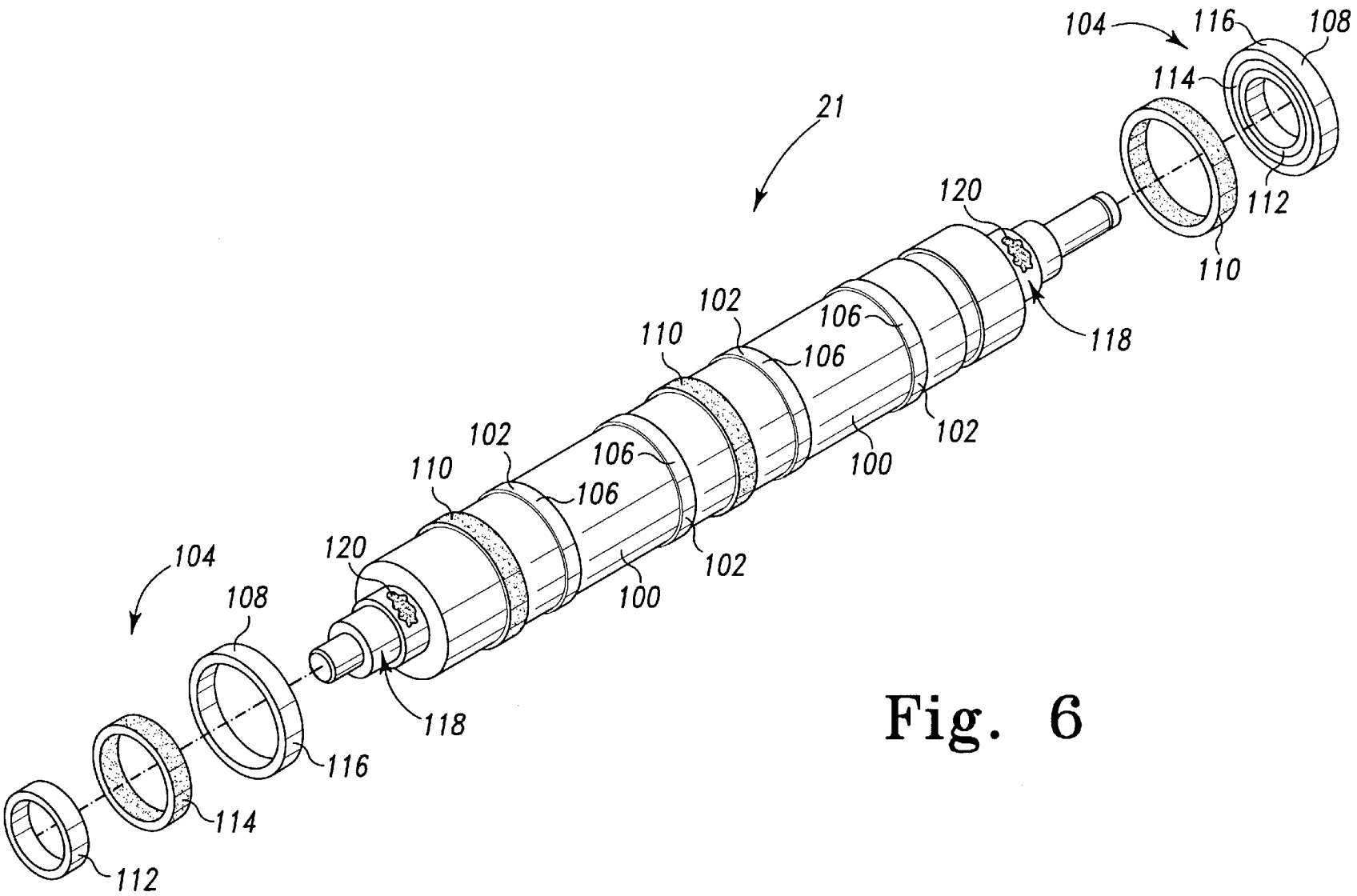
FIG. 6 is a perspective view of one of the folding and sealing rollers of the folder-sealer device of FIG. 1.

Referring now to FIG. 6, there is shown the roller 21 in more detail. The roller 21 is milled from a metallic material having a roller surface 100 defined therein which extends along the length of the roller 21. For example, the roller 21 may be milled from a solid or tube-shaped piece of steel or aluminum. The roller 21 further has a number of inner annular rings 102 defined therein. The inner annular rings 102 define a first number of band members or sealing protrusions which are milled into a central portion of the roller 21 so as to extend outwardly from the roller surface 100. The roller 21 also includes a pair of outer annular ring assemblies 104 which are secured to the end portions of the roller 21 so as protrude radially from the outer surface of the roller surface 100. Each of the inner annular rings 102 defines a sealing surface 106, whereas each of the outer annular rings 104 defines a sealing surface 108.

As shown in FIG. 6, each of the outer annular ring assemblies 104 includes a metallic inner sleeve 112, a deformable inner ring member 114, and a metallic outer ring member 116. The deformable inner ring member 114 is interposed between the inner sleeve 112 and the outer ring member 116. In particular, the deformable inner ring member 114 is secured to the outer periphery of the inner sleeve 112, whereas the outer ring member 116 is secured to the outer periphery of the deformable inner ring member 114. Both the inner sleeve 112 and the outer ring member 116 are preferably constructed of a steel such as stainless steel, whereas the deformable inner ring member 114 is preferably constructed of a deformable, flexible material such as urethane. One such urethane which may be utilized in the construction of the inner ring member 114 of the present invention is commercially available from Mearthane Products of Cranston R.I. as 60 Shore D urethane.

One of the outer annular ring assemblies 104 is secured to each end portion of the roller 21. In particular, as shown in FIG. 6, the diameter of each end of the roller 21 is milled down so as to define a mounting recess 118. An adhesive 120 is positioned on the milled down portion of the roller 21 within the mounting recess 118. Each of the outer ring assemblies 104 are snap fit onto the roller 21 such that the adhesive 120 is interposed between the milled down portion of the roller 21 and the inner surface of the inner sleeve 112. The adhesive may be any type of adhesive which prevents the outer ring assemblies 104 from rotating relative to the roller 21. One such adhesive which is suitable for use as the adhesive 120 of the present invention is Loctite Shaft Retaining Compound (part number 68060) which is commercially available from Loctite Corporation of Rocky Hill, Conn. It should be appreciated that a primer, such as Locquic Primer T (part number 7471) which is also available from Loctite Corporation, may be utilized to prime the roller 21 and the inner sleeve 112 prior to application of the adhesive 120.

Figure 7B:
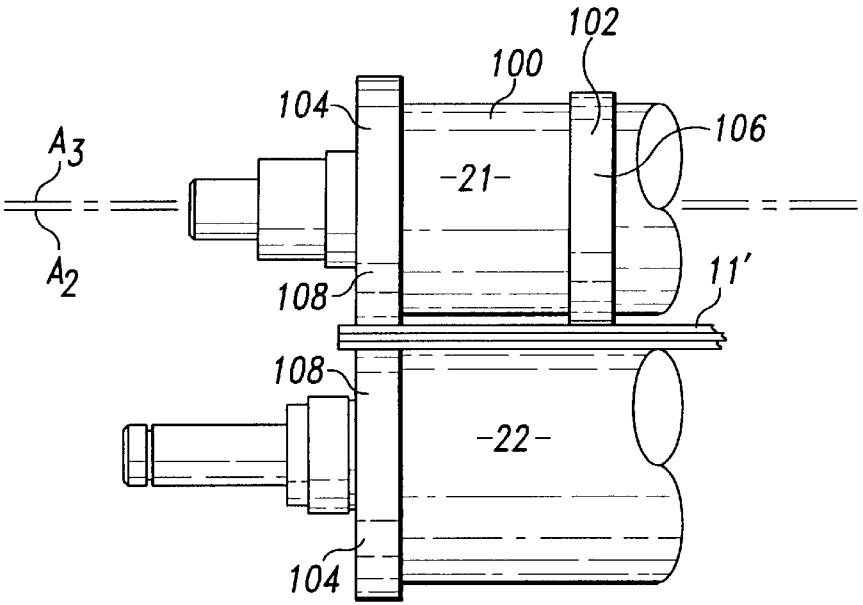
FIG. 7B is a view similar to FIG. 7A, but showing the outer annular ring assemblies of the folding and sealing rollers in a compressed orientation.
Figure 7A:
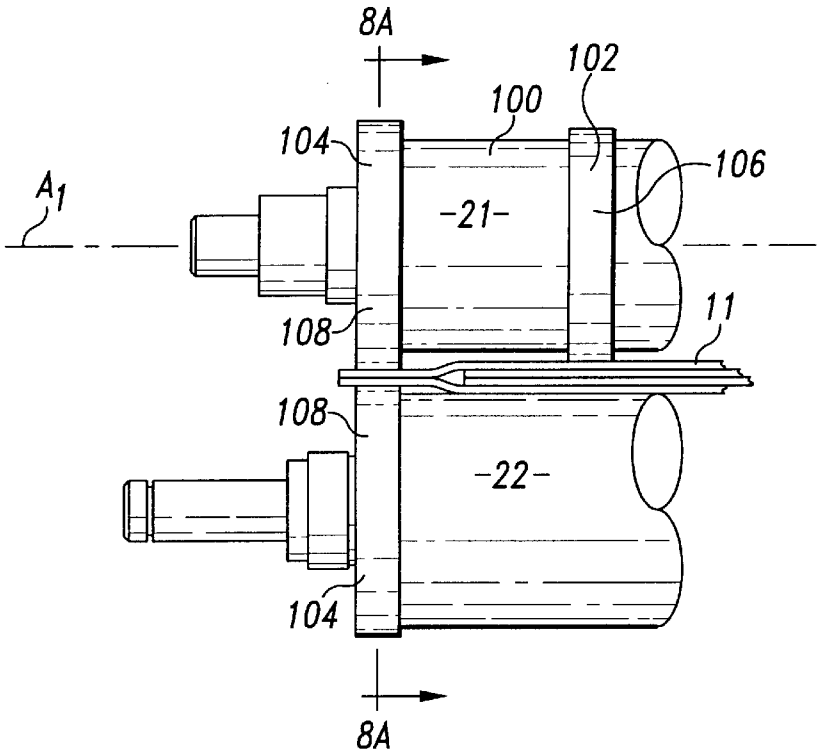
FIG. 7A is a front elevational view which shows the outer annular ring assemblies of the folding and sealing rollers in an uncompressed orientation.

Moreover, as shown in FIGS. 2, 7A, and 7B, the roller 22 also has an outer annular ring assembly 104 secured to each end portion thereof. As described below, the outer annular ring assemblies 104 of the roller 21 cooperate with the outer annular ring assemblies 104 of the roller 22 in order to seal the lateral edge portions 67, 69 of the mailer form 11 as the mailer form 11 passes between the roller 21 and the roller 22.

Figure 14:
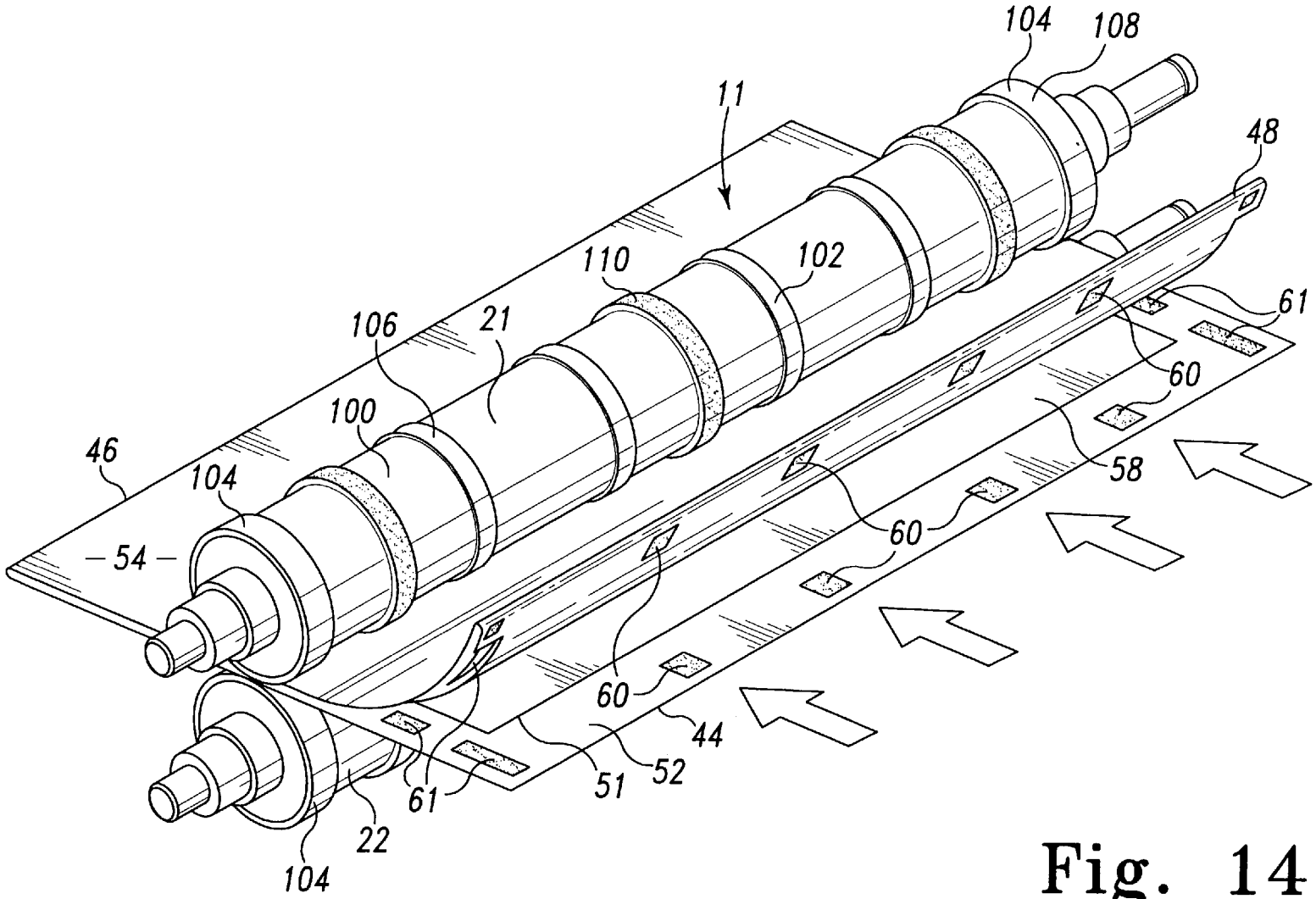
FIG. 14 is a perspective view showing the mailer form being advanced between the folding and sealing rollers of the folder-sealer device of FIG. 1.

As the mailer form 11 passes between the roller 21 and the roller 22, the sealing surfaces 106, 108 of the roller 21 are in operative contact with the roller 22 (see FIG. 4D). In particular, as shown in FIG. 14, during advancement of the mailer form 11 between the roller 21 and the roller 22, the adhesive patches 60 (see also FIG. 3) on the mailer form 11 are aligned with the sealing surfaces 106 of the inner annular rings 102 such that the adhesive patches 60 disposed in the transverse edge portion 63 and the adhesive patches 60 disposed in the transverse edge portion 65 are urged into contact with one another. Similarly, as shown in FIG. 14, during advancement of the mailer form 11 between the roller 21 and the roller 22, (1) the adhesive patches 61 located in the lateral edge portion 67 of the first sheet segment 52 align with the adhesive patches 61 located in the lateral edge portion 67 of the second sheet segment 54, and (2) the adhesive patches 61 located in the lateral edge portion 69 of the first sheet segment 52 align with the adhesive patches 61 located in the lateral edge portion 69 of the second sheet segment 54. Moreover, during such advancement between the roller 21 and the roller 22, the sealing surfaces 108 of the outer ring assemblies 104 of both the roller 21 and the roller 22 align with the adhesive patches 61 so as to urge the adhesive patches 61 disposed in the first sheet segment 52 into contact with the corresponding adhesive patches 61 disposed in the second sheet segment 54 (see FIG. 14).

Such a configuration allows a relatively large sealing force to be exerted on the adhesive patches 60 ands 61 in order to seal the mailer form 11 without directing the sealing force onto the remaining portions of the mailer form 11. In particular, since the biasing force exerted on the roller 21 by the biasing lever arm 86 is transferred to the roller 22 (and hence the mailer form 11 if the mailer form 11 is positioned between the roller 21 and the roller 22) through only the sealing surfaces 106, 108 of the roller 21, the sealing pressure exerted through the sealing surfaces 106, 108 is substantially greater than the sealing pressure that would be generated if the roller 21 did not have the annular rings 102 and the outer annular ring assemblies 104 protruding from the roller surface 100. In other words, the sealing pressure exerted through the sealing surfaces 106, 108 is substantially greater than the sealing pressure that would be generated if a biasing force of the same magnitude was spread across the entire length of the roller 21 as would be the case if the roller 21 was embodied as a flat roller. By applying the sealing pressure to the adhesive patches 60 and 61 through the sealing surfaces 106, 108, respectively, the adhesive patches 60 and 61 adhere to the adjacent surfaces of the mailer form 11 (including corresponding adhesive patches 60 and 61) so as to seal the mailer form 11 as the second fold is formed in the mailer form 11 (see FIG. 4D and 5E).

As alluded to above, it should be appreciated that the magnitude of the biasing force generated by the biasing lever arm 86 and transferred from the roller 21 to the roller 22 in the general direction of arrow 84 can be significantly reduced relative to the magnitude of the sealing force which would be required to produce adequate sealing pressure along the entire length of the roller 21. In particular, the aggregate width of the sealing surfaces 106, 108 are approximately eighteen percent of the width of the mailer form 11. Therefore, only eighteen percent as much biasing force needs to be applied to the roller 21 to exert the sealing pressure to the sealing surfaces 106, 108 relative to the biasing force that would have to be exerted on the roller 21 if the roller 21 was embodied as a substantially flat roller (i.e. without the sealing surfaces 106, 108). Such a reduction in the magnitude of the force between the roller 21 and the roller 22 which is necessary to seal the mailer form 11 reduces the amount of power that the motor 26 must supply to rotate the roller 21 and the roller 22. By reducing the amount of power required to rotate the roller 21 and the roller 22, the folder-sealer device 10 can employ a smaller, less expensive motor 26 and power supply 32 relative to heretofore designed devices thereby significantly reducing costs associated with manufacture of the folder-sealer device 10.

However, the small contact area between the sealing surfaces 106, 108 of the roller 21 and the roller 22 reduces the frictional force on the mailer form 11 as the mailer form 11 is drawn into the nip 82 (see FIG. 4C). To increase the frictional force used to draw the mailer form 11 into the nip 82, the roller 21 further includes a number of sheet grippers 110 positioned between the annular rings 102, 104 (see FIGS. 2 and 6). Each sheet gripper 110 is an elastomeric member that extends around the roller surface 100 of the roller 22 and is composed of soft urethane. One soft urethane that may be used in the present invention is available from Mearthane Products of Cranston R.I. as 65 Shore A urethane. The sheet grippers 110 extend radially beyond the sealing surfaces 106, 108 such that the sheet grippers 110 come into contact with the mailer form 11 and advance the mailer form 11 toward the nip 82 between the roller 21 and the roller 22. In addition, the soft urethane of the sheet gripper 110 compresses to allow the sealing surfaces 106 and 108 to be placed in operative contact with the roller 22 as the mailer form 11 is advanced between the roller 21 and the roller 22. Preferably, as shown in FIG. 2, the roller 22 also has a number of the sheet grippers 110 secured thereto in order to further enhance the sheet advancing capability of the combination of the roller 21 and the roller 22.

Figure 8B:
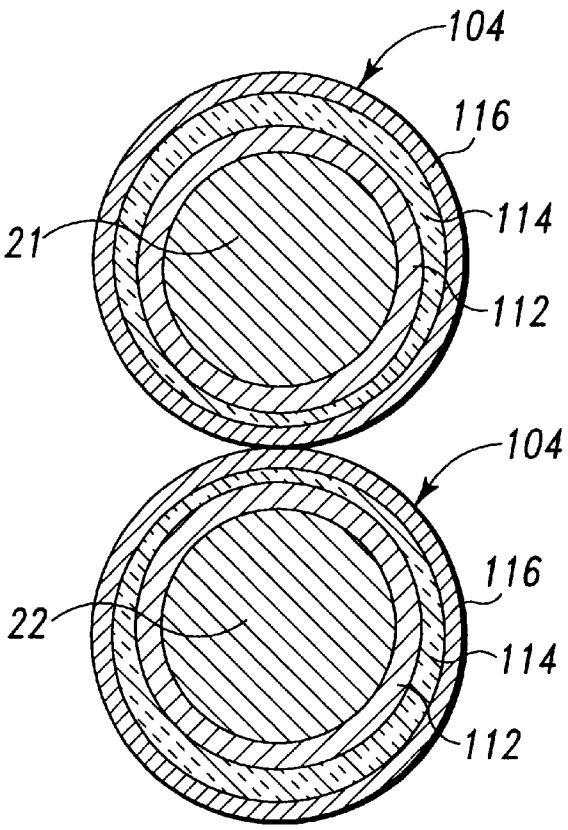
FIG. 8B is a view similar to FIG. 8A, but showing the outer annular ring assemblies in the compressed orientation.
Figure 8A:
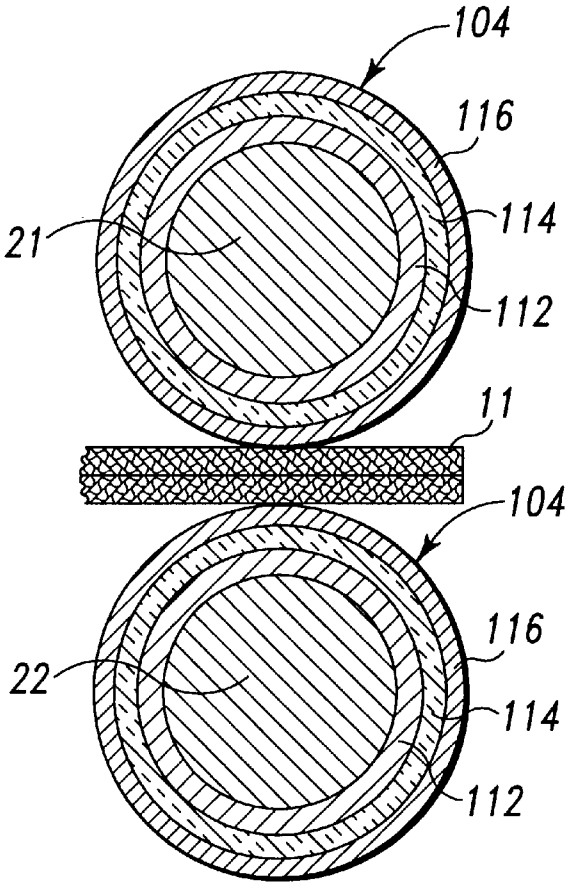
FIG. 8A is cross sectional view taken along the line 8A—8A of FIG. 7A which shows the outer annular ring assemblies in the uncompressed orientation.

During advancement of the mailer form 11 between the roller 21 and the roller 22, the mailer form 11 is folded such that the inner portion of the mailer form 11 (i.e. the portion of the folded mailer form 11 which includes all four sheet segments 52, 54, 56, 58) is four paper layers thick, whereas the outer portion of the folded mailer form 11 (i.e. the portion of the folded mailer form which includes the lateral edge portions 67, 69) is only 2 paper layers thick. Therefore, the sealing surfaces 108 of the outer annular ring assemblies 104 must preferably extend radially beyond the sealing surfaces 106 of the inner annular rings 102 to compensate for the varying thickness of the folded mailer form 11. Hence, the outer annular ring assemblies 104 are positionable in either a compressed orientation or an uncompressed orientation. In particular, the deformable inner ring member 114 of the outer annular ring assemblies 104 is slightly compressed when either (1) no sheets are positioned between the roller 21 and the roller 22 (see FIG. 8B), or (2) the thickness of the inner portion a mailer form is the same as the outer portion of a folded mailer form (i.e. the same number of sheets are positioned between the outer annular ring assemblies 104 of the rollers 21, 22 as are positioned between the inner annular rings 102 of the roller 21 and the outer surface of the roller 22, as shown in FIG. 7B). As discussed below in greater detail, certain types of mailing forms are configured so as to have a similar thickness in both the inner and outer portion thereof during advancement between the roller 21 and the roller 22. However, in the case of the mailer form 11 where the inner portion is four paper layers thick and the outer portion is only two paper layers thick during advancement between the roller 21 and the roller 22, the deformable inner ring member 114 of the outer ring assemblies 104 is uncompressed (see FIGS. 7A and 8A) so as to allow the outer periphery of the outer ring member 116 (i.e. the sealing surface 108) to come into contact with the lateral edges 67, 69 of the mailer form 11 thereby causing sealing of the respective adhesive patches 61 to one another.

Therefore, as shown in FIG. 7A, when the outer annular ring assemblies 104 of the roller 21 are positioned in their uncompressed orientation (i.e. the deformable inner ring members 114 are not compressed), both the inner annular rings 102 and the outer annular ring assemblies 104 have a common axis of rotation, as designated by line $A_1$ of FIG. 7A. However, when the outer annular ring assemblies 104 of the roller 21 are positioned in their compressed orientation (i.e. the deformable inner ring members 114 are slightly compressed), the inner annular rings 102 have an axis of rotation (designated by line $A_2$ of FIG. 7B) which is different form the axis of rotation of the outer annular ring assemblies 104 (designated by line $A_3$ of FIG. 7B). Such varying axes of rotation facilitate sealing of various configurations of mailer forms. In particular, such varying axes of rotation allow the for the sealing of folded mailer forms which have a different number of sheets on the outer edges of the form relative to the central portion of the folded form (e.g. the mailer form 11). The sealing of such forms would be difficult, if not impossible, with a flat roller which has only a single axis of rotation.

Figure 9:
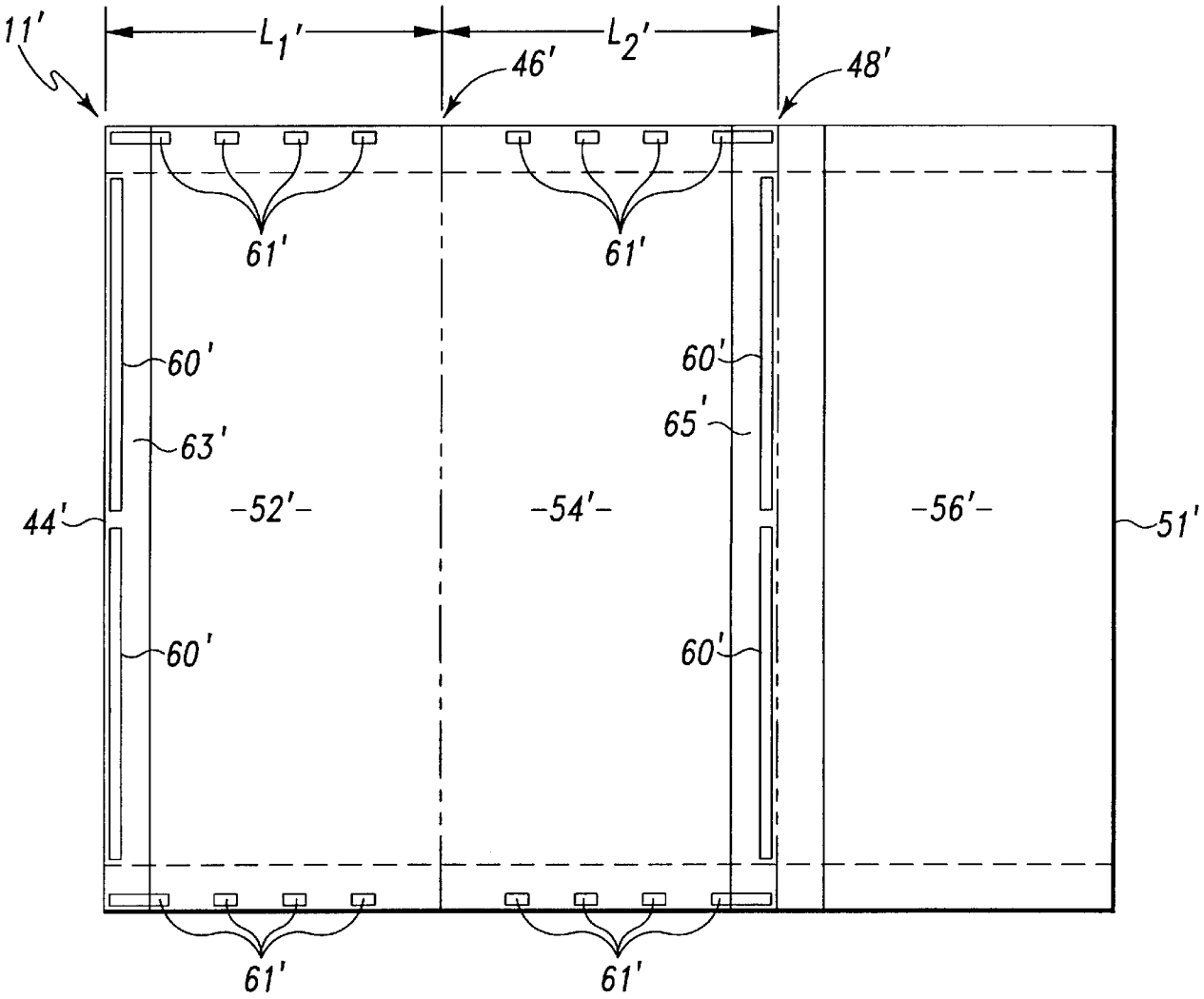
FIG. 9 is a top elevational view of a tri-fold mailer form which is alternatively folded and sealed in the folder-sealer device of FIG. 1.

Referring now to FIG. 9, the folder-sealer device 10 is also operable to fold and seal alternate mailer form configurations, such as a tri-fold mailer form 11'. The tri-fold mailer form 11' includes a first perforated line 46' and a second perforated line 48' which divide the form 11' into a first sheet segment 52', a second sheet segment 54', and a third sheet segment 56'. To fold the tri-fold mailer form 11', the first sheet stop 66 is adjusted to form the first fold at a first perforated fold 46', and the second sheet stop 76 is adjusted to form the second fold at a second perforated fold 48'.

The tri-fold mailer form 11' includes a number of adhesive patches 60' which are disposed in a first transverse edge portion 63' and a second number of adhesive patches 60' which are disposed in the second transverse edge portion 65'. The adhesive patches 60' of the transverse edge portions 63', 65' are aligned with the sealing surfaces 106 of the inner annular rings 102 as the folded tri-fold mailer form 11' passes between the roller 21 and the roller 22. Moreover, the tri-fold mailer form 11' includes a number of adhesive patches 61' which are disposed in a first lateral edge portion 67', and a second number of adhesive patches 61' which are disposed in the second lateral edge portion 69'. The adhesive patches 61' of the lateral edge portions 67', 69' are aligned with the sealing surfaces 108 of the outer annular ring assemblies 104 as the folded tri-fold mailer form 11' passes between the roller 21 and the roller 22.

As the tri-fold mailer form 11' is advanced between the roller 21 and the roller 22, the patches 60' and the patches 61' are placed in locations where the form 11' is three paper layers thick. In particular, the patches 60' and 61' are located within portions of the tri-fold mailer form 11' which include the first sheet segment 52', the second sheet segment 54', and the third sheet segment 56'. Therefore, the sealing surfaces 108 of the outer annular ring assemblies 104 must preferably extend radially from the roller surface 100 the same distance as the sealing surfaces 106 of the inner annular rings 102 to seal the folded tri-fold mailer form 11'. Hence, as described above, the configuration of the outer annular ring assemblies 104 accommodates the different sealing requirements of the mailer form 11 and the tri-fold mailer form 11'. In particular, as discussed above, in the case of advancement of the mailer form 11 between the roller 21 and the roller 22, the inner portion of the mailer form 11 is four paper layers thick, whereas the outer portions of the mailer form 11 (i.e. the edge portions 63, 65, 67, 69) is only two paper layers thick. Therefore, the deformable inner ring member 114 of the outer annular ring assemblies 104 decompresses so as to allow the respective sealing surfaces 108 to contact the outer portions of the mailer form 11 in order to seal the respective adhesive patches 60 to one another. However, in the case of advancement of the mailer form 11' between the roller 21 and the roller 22, both the inner portion and the outer portion of the mailer form 11' are three paper layers thick. Thus, since the folded tri-fold mailer form 11' has the same number of layers proximate to the sealing surfaces 106 of the inner annular rings 102 as it does proximate to the sealing surfaces 108 of the outer annular ring assemblies 104, the deformable inner ring member 114 of each of the outer annular ring assemblies 104 compresses as shown in FIG. 7B. The compression of the deformable inner ring members 114 allows the sealing surfaces 106 of the inner annular rings 102 to apply the sealing pressure to the adhesive patches 60', while also allowing the sealing surfaces 108 of the compressed outer annular ring assemblies 104 to apply a sealing pressure to the patches 61'.

Figure 10C:
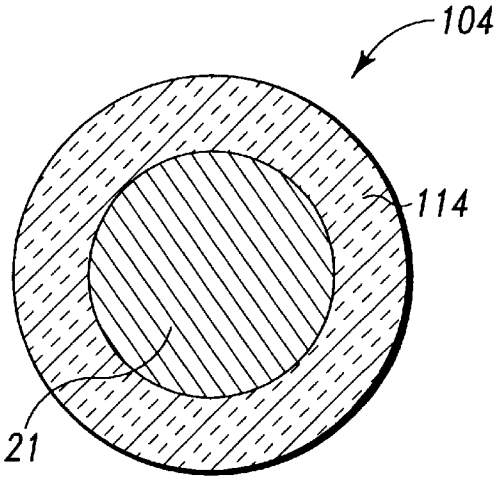
FIGS. 10A–10C are views similar to FIG. 8A, but showing alternative embodiments of the outer annular ring assemblies.
Figure 10B:
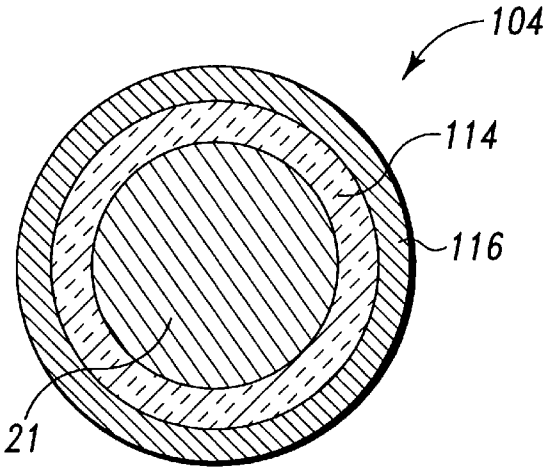
Figure 10A:
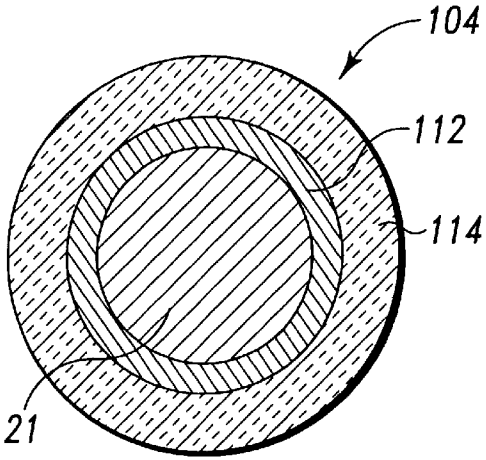

Referring now to FIGS. 10A, 10B, and 10C there is shown alternative embodiments of the outer annular ring assemblies 104. In particular, as shown in FIG. 10A, the metallic outer ring member 116 may be removed in lieu of a larger diameter deformable inner ring member 114. Moreover, as shown in FIG. 10B, the metallic inner sleeve 112 may be removed, and the deformable inner ring member 114 may be secured directly to the outer periphery of the roller surface 100 by use of an adhesive or the like. Yet further, as shown in FIG. 10C, both the inner sleeve 112 and the metallic outer ring member 116 may be removed, and a large-diameter deformable ring member 114 may be secured directly to the outer periphery of the roller surface 100 by use of an adhesive or the like. It should be appreciated that the alternative embodiments of the outer annular ring assemblies 104 shown in FIGS. 10A, 1B, and 10C, or any combination thereof, may be utilized so as to fit the requirements of a given folder-sealer device 10.

Figure 11C:
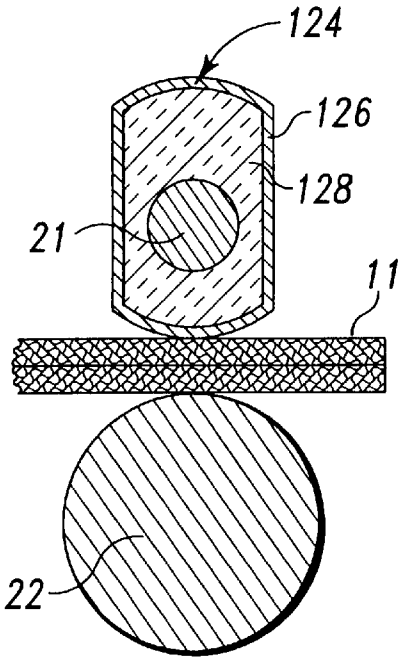
FIGS. 11A–11C show additional alternative embodiments of the outer annular ring assemblies.
Figure 11B:
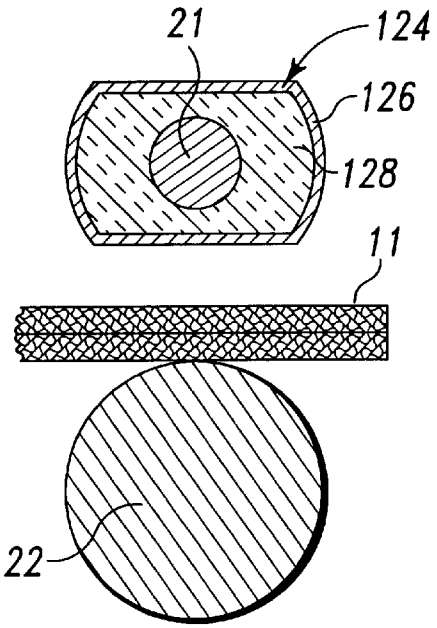
Figure 11A:
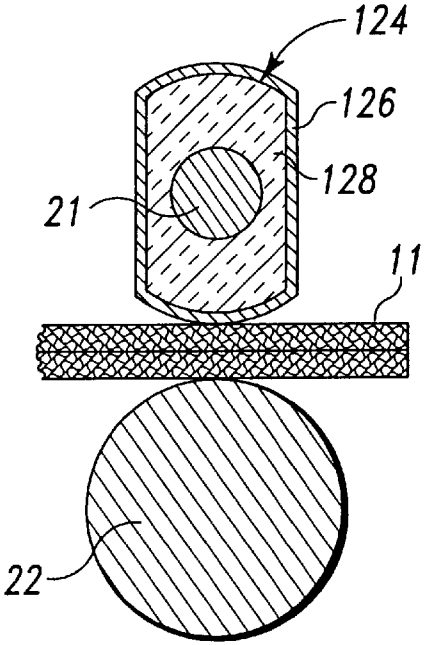

Moreover, as shown in FIGS. 11A, 11B, and 11C, an additional alternative compressible outer ring assembly 124 is shown. In this case, the outer ring assembly 124 includes a double-D shaped outer metallic ring member 126 and a deformable inner ring member 128. As with the deformable inner ring member 114 of the outer annular ring assembly 104, the inner ring member 128 is preferably constructed of a deformable, flexible material such as urethane. It should be appreciated that use of the deformable inner ring member 128 allows the outer ring assembly 124 to be compressed so as to enable sealing of folded mailer forms which have a varying sheet thickness in a manner similar to the outer annular ring assemblies 104. Moreover, as shown in FIG. 11B, the double-D shape of the outer metallic ring member 126 enables the outer ring assembly 124 to be selectively positioned in an orientation which allows a section of a mailer form to be passed between the roller 21 and the roller 22 without being sealed or otherwise contacted by the outer ring assembly 124.

Figure 12:
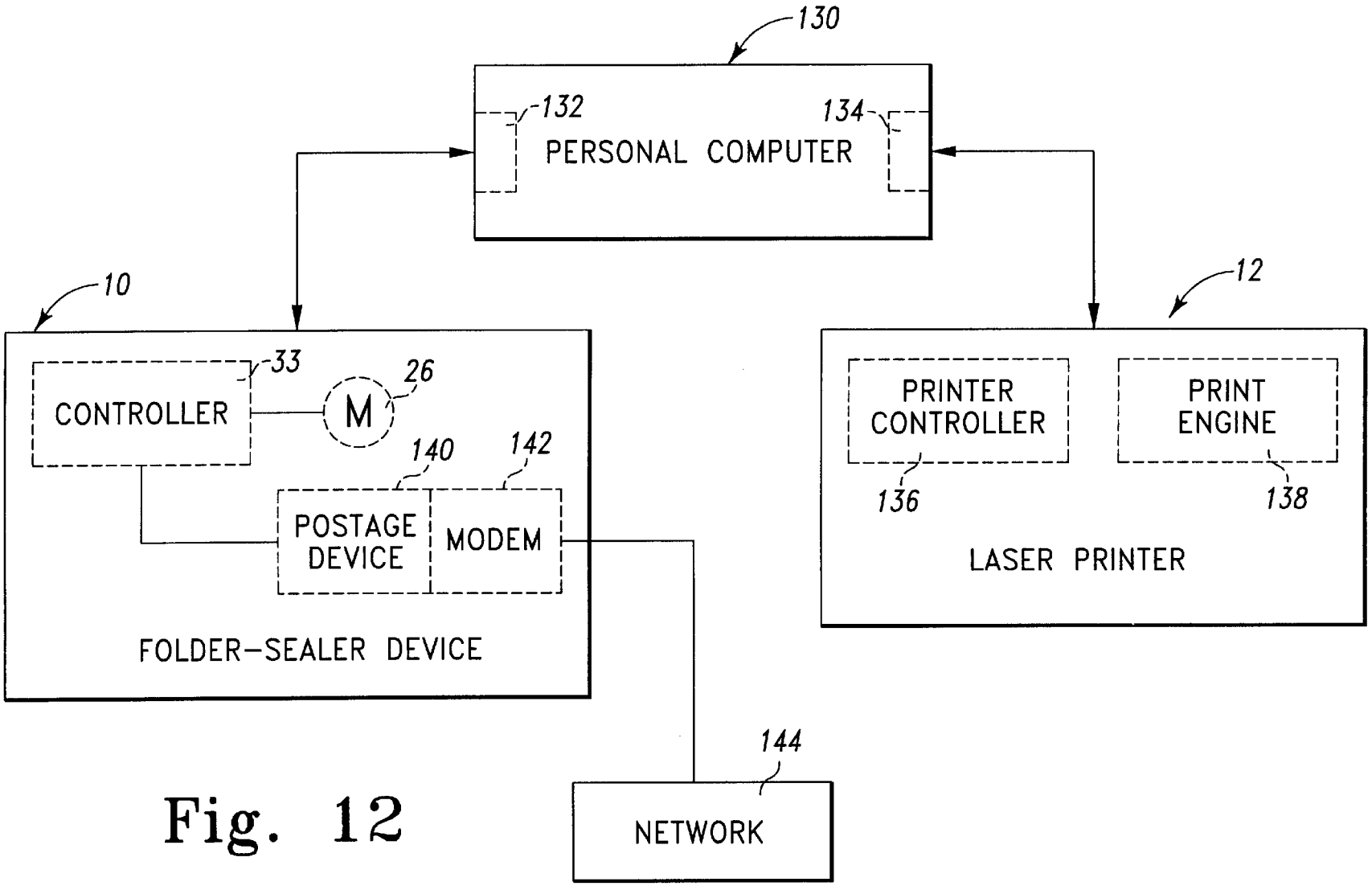
FIG. 12 is a simplified block diagram which shows the folder-sealer device of FIG. 1 electrically coupled to a personal computer and a laser printer.

Referring now to FIG. 12, both the folder-sealer device 10 and the laser printer 12 are electrically coupled to a respective communication port 132, 134 of the personal computer 130. The folder-sealer device 10 and the laser printer 12 are each configured to communicate with the personal computer 130 via any one of a number of commercially utilized serial, parallel, or USB communication protocols. Moreover, such a configuration allows the controller 33 of the folder-sealer device 10 to communicate with a printer controller 136 associated with the laser printer 12 in order to coordinate advancement of the mailer forms 11 out of the output mechanism of the laser printer 12 and into the folder-sealer device 10.

The personal computer 130 is utilized to communicate electronic data associated with images which are to be printed to the printer controller 136 associated with the laser printer 12 such that such images are printed on the mailer forms 11 (or the tri-fold mailer forms 11') during advancement of the forms through a print engine 138 associated with the laser printer 12. It should be appreciated that such images may include text associated with a message such as a confidential message, payroll information, or a customer-specific advertisement. Moreover, such images may also include the delivery and return address associated with the mailer form 11, 11'. It should be further appreciated that the printing software executed by the personal computer 130 communicates with the printer controller 136 such that the printed images (e.g. a confidential message, a delivery address, and a return address) are printed at the appropriate location on the mailer form 11, 11'.

As described above, the mailer forms 11, 11' exiting the laser printer 12 may be folded and sealed by the folder-sealer device 10 prior to being mailed. However, prior to being deposited in the mail, postage must be affixed to the folded and sealed mailer forms 11, 11'. Postage may be affixed to the folded and sealed mailer forms 11, 11' in a number of different manners. For example, a stamp may be manually affixed to each of the folded and sealed mailer forms 11, 11'. Moreover, each of the folded and sealed mailer forms 11, 11' may be advanced through a postage meter (not shown) in order to have postage indicia printed thereon. However, the folder-sealer device 10 is preferably configured so as to include a postage device 140 secured within the housing 15 thereof.

The postage device 140 includes a modem 142 which is utilized to communicate with an electronic postage vendor via a network 144. In such a configuration, an electronic postage account may be maintained which allows the user of the folder-sealer device 10 to purchase postage electronically from a postage vendor. Thereafter, as mailer forms 11, 11' are advanced through the print engine 138 of the laser printer 12, the postage device 140 communicates with the print controller 136 (via the personal computer 130) so as to cause postage indicia to be printed on the appropriate location of the mailer form 11, 11'. It should be appreciated that in certain configurations, it may be desirable to electrically couple the postage device 140 directly to an input port (not shown) associated with the printer controller 136 of the laser printer 12 (as opposed to coupling the postage device 140 to the printer controller via the personal computer 130). Moreover, it should be further appreciated that in certain configurations, it may be desirable to utilize a modem associated with the personal computer 130 (not shown) in order to communicate with the electronic postage vendor thereby eliminating the need to provide the postage device 140 with a separate modem (i.e. the modem 142). Such component reduction reduces costs associated with the folder-sealer device 10.

The postage device 140 may be configured to cause postage indicia of any accepted format to be printed on the mailer forms 11, 11'. For example, the postage device 140 may be utilized to print two-dimensional bar codes which are compliant with the newly adopted Information Based Indicia Program (IBIP). As the format of federal or international postage indicia changes, the postage device 140 may be retrofit, reprogrammed, or otherwise modified to support a revised format.

As described herein, use of the postage device 140 allows the folder-sealer device 10 to be utilized as a single, integrated solution for folding, sealing, and postage marking a mailer form. Moreover, although the postage device 140 is described herein as being secured within the housing 15, and has significant advantages thereby in the present invention, it should be appreciated that certain of such advantages may be achieved by securing the postage device 140 in another manner. For example, the postage device 140 may be secured to the outside of the housing 15, or may simply be positioned proximate to the folder-sealer device 10 without actually being secured to the housing 15.

Figure 13:
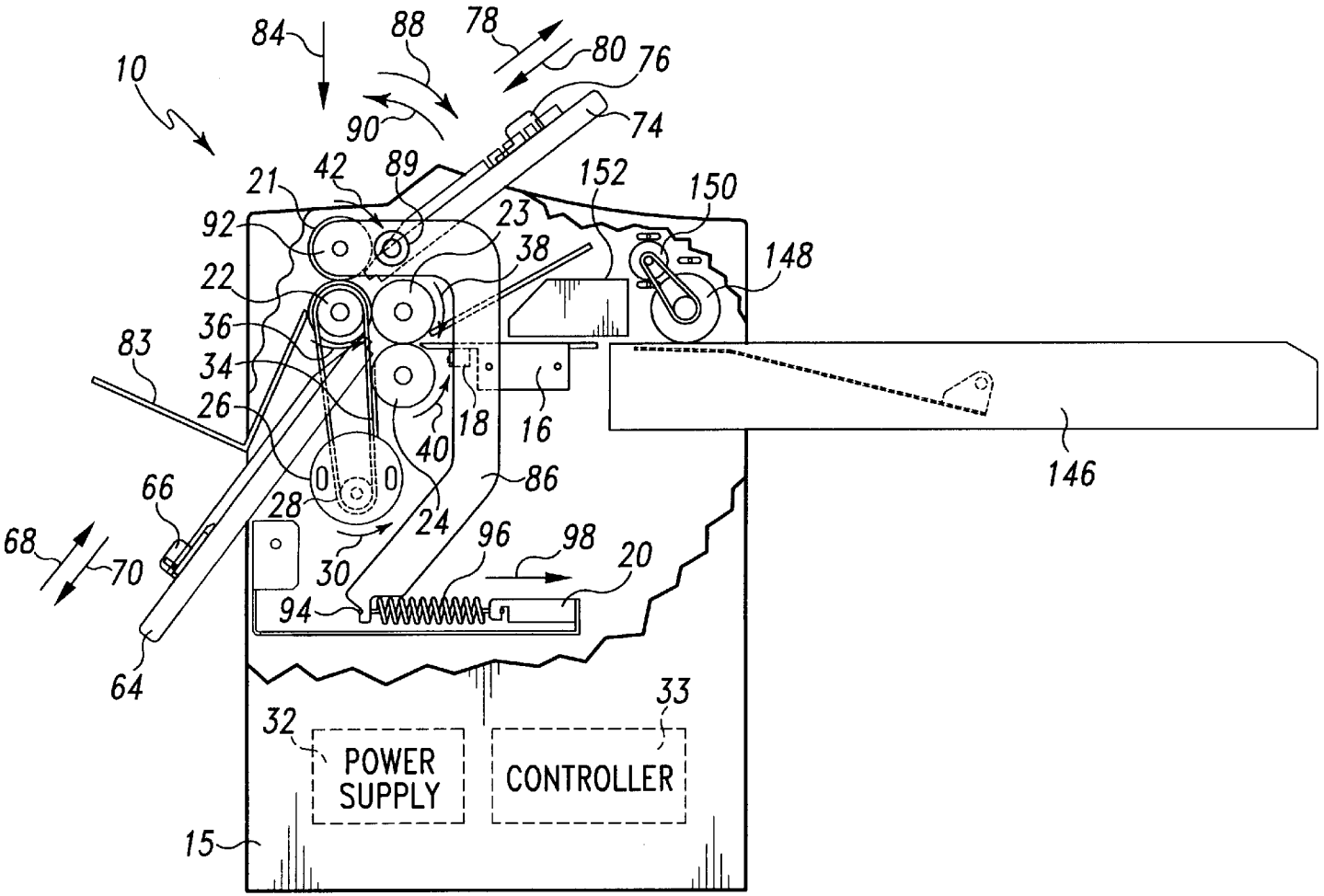
FIG. 13 is a view similar to FIG. 1, but showing the folder-sealer device configured as a "stand alone" device.

Referring now to FIG. 13, the folder-sealer device 10 may also be configured as a "stand alone" device which may be utilized to fold and seal preprinted mailer forms advanced from a manual feed tray such as a paper cassette 146 (as opposed to being advanced by the output mechanism of the laser printer 12). In particular, the paper cassette 146 is secured to the housing 15 of the folder-sealer device 10 such that preprinted mailer forms are advanced out of the paper cassette 146 and into the input guide 16. The preprinted mailer forms are then folded and sealed in the manner previously discussed and thereafter advanced into the output tray 83.

As described above, when the folder-sealer device 10 is coupled to the laser printer 12, the output mechanism associated with the laser printer 12 advances the mailer forms through the input guide 16 and into the nip of the rollers 23, 24. In the "stand alone" configuration, the folder-sealer device 10 itself must advance the preprinted forms through the input guide 16 and into the nip of the rollers 23, 24. In particular, the folder-sealer device 10 includes an input feed roller 148 which is operatively coupled to an output shaft of an input drive motor 150. Operation of the input drive motor 150 causes rotation of the input feed roller 148 thereby advancing the preprinted mailer forms out of the paper cassette 146, through the input guide 16, and into the nip of the rollers 23, 24. The mailer forms are then folded and sealed in the manner previously discussed and thereafter advanced into the output tray 83.

Hence, as described above, the folder-sealer device 10 is operable in either a manual-feed mode of operation or a printer-feed mode of operation. When the folder-sealer device 10 is operated in its printer-feed mode of operation, the paper cassette 146 is removed and the housing 15 is secured to the laser printer 12. The output mechanism of the laser printer 12 selectively advances printed mailer forms 11, 11' through the input guide 16 and into the nip of the rollers 23, 24. However, when the folder-sealer device 10 is operated in its manual-feed mode of operation, the housing 15 is detached from the laser printer 12 such that the paper cassette 146 may be secured thereto. Thereafter, preprinted mailer forms 11, 11' are advanced through the input guide 16 and into the nip of the rollers 23, 24 by the input feed roller 148.

Moreover, as shown in FIG. 13, the folder-sealer device 10 may also be configured with a printing device 152. The printing device 152 is particularly useful for printing indicia, such as postage indicia or recipient address information, on the mailer forms 11, 11' when the folder-sealer device 10 is configured in its "stand alone" configuration. The printing device 152 may be configured as any known printing device such as an ink-jet printing device or a laser printing device. Moreover, the printing device 152 may be controlled by the personal computer 130, or alternatively, the controller 33 may be configured to control operation of the printing device 152. In addition, it should be appreciated that the printing device 152 may alternatively be located within the folder-sealer device 10 at location between the exit of the rollers 21, 22 and the output tray 83 such that indicia is printed on the mailer forms 11, 11' after the forms have been folded and sealed.

While the invention has been illustrated and described in detail in the drawings and foregoing description, such illustration and description is to be considered as exemplary and not restrictive in character, it being understood that only the preferred embodiment has been shown and described and that all changes and modifications that come within the spirit of the invention are desired to be protected.

For example, it should be appreciated that a guide member may be positioned over the chute 64 in order to ensure that the mailer form 11 buckles only at the perforated line 48. Also, it should be appreciated that another guide member may be positioned over the chute 74 in order to ensure that the mailer form 11 buckles only at the perforated lines 46, 50. Note that if a guide member was not positioned over the chute 64, it is possible that the mailer form 11 may buckle at the perforated line 46 during advancement of the mailer form 11 against the stop 66. In any event, providing guide members over the chutes 64, 74 facilitates proper advancement of the mailer form 11 within the folder-sealer device 10.

Figure 15:
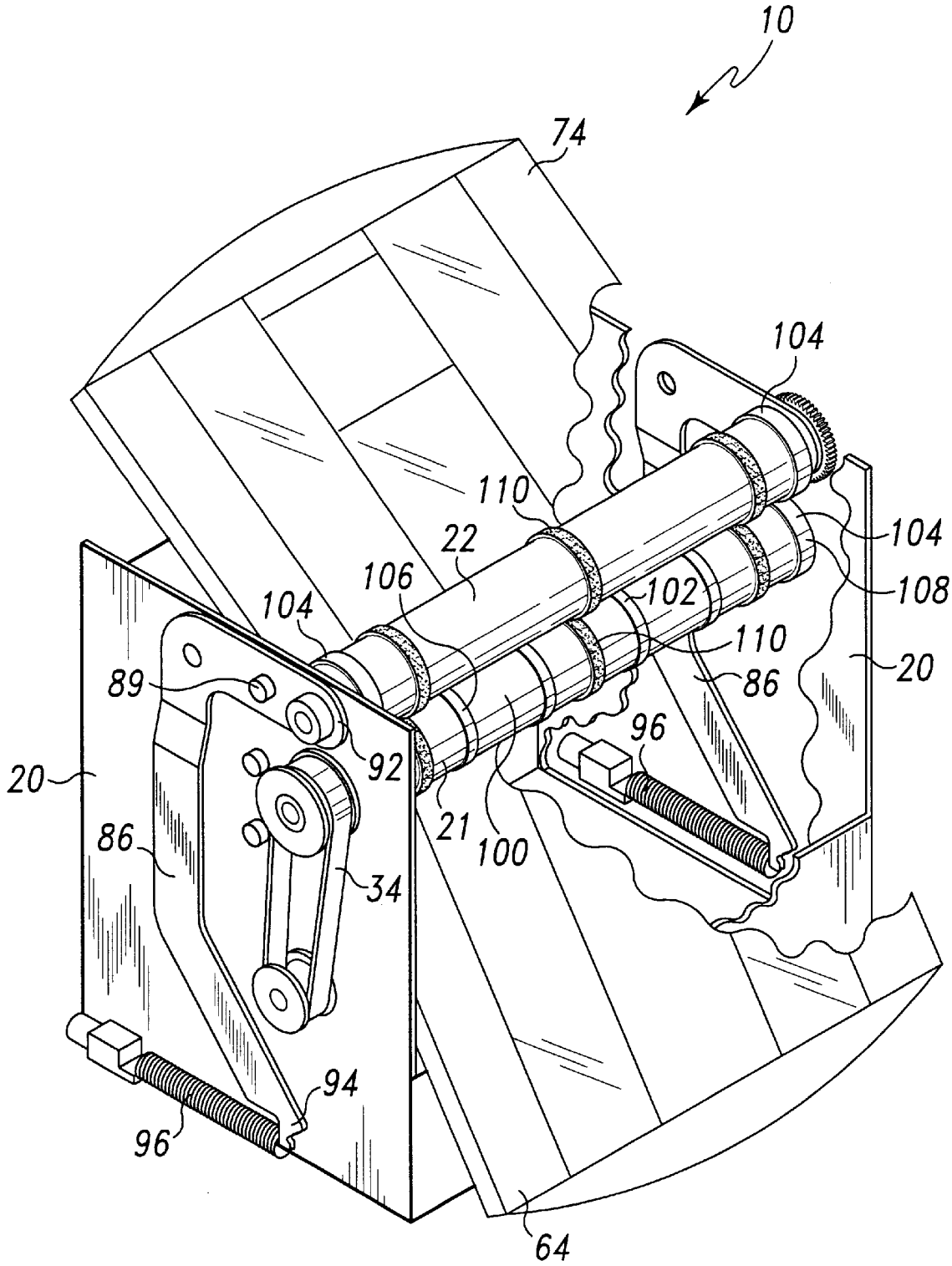
FIG. 15 is a view similar to FIG. 2, but showing an alternate roller arrangement of the folder-sealer device.

Moreover, although the folder-sealer device 10 is herein described as having the roller 21 positioned over the roller 22, with such a roller configuration having significant advantages in the present invention, certain of such advantages may be achieved with other roller configurations. For example, as shown in FIG. 15, the location of the roller 21 and the roller 22 may be swapped such that the roller 22 is located above the roller 21. In such a configuration, the biasing lever arms 86 would be coupled to the roller 22 so as to bias the roller 22 downwardly and into operative contact with the roller 21.

There are a plurality of advantages of the present invention arising from the various features of the folder-sealer device described herein. It will be noted that alternative embodiments of the folder-sealer device of the present invention may not include all of the features described yet still benefit from at least some of the advantages of such features. Those of ordinary skill in the art may readily devise their own implementations of the folder-sealer device that incorporate one or more of the features of the present invention and fall within the spirit and scope of the present invention as defined by the appended claims.

What is claimed is:

1. A method of operating a folder-sealer apparatus, comprising the steps of:

advancing a mailer form into a print engine of a printing device;

operating a postage device associated with said folder-sealer apparatus so as to generate an electronic representation of postage indicia;

transmitting said electronic representation of said postage indicia to said printing device;

printing said postage indicia on said mailer form with said print engine in response to said transmitting step; and advancing said mailer form out of said print engine and into a roller assembly associated with said folder-sealer apparatus.

2. The method of claim 1, further comprising the steps of:

folding said mailer form with said roller assembly; and sealing said mailer form with said roller assembly, wherein said folding step is performed contemporaneously with said sealing step.

3. The method of claim 1, wherein:

said printing device includes a laser printer, and said step of advancing said mailer form out of said print engine includes the step of advancing said mailer form from an output of said laser printer and into said roller assembly associated with said folder-sealer apparatus.

4. The method of claim 1, wherein:

both said postage device and said printing device are electrically coupled to a computing device, and said transmitting step includes the steps of transmitting said electronic representation of said postage indicia to said computing device.

5. The method of claim 4, wherein:

said computing device includes a personal computer, said printing device includes a laser printer, said postage device is electrically coupled to a first communication port of said personal computer, said laser printer is electrically coupled to a second communication port of said personal computer, said transmitting step includes the step of transmitting said electronic representation of said postage indicia to said personal computer via said first communication port, and said printing step includes the step of printing said postage indicia on said mailer form with said laser printer.

6. A folder-sealer apparatus for folding and sealing a mailer form, comprising:

a housing;

a roller assembly for folding and sealing said mailer form, said roller assembly being positioned within said housing; and a postage device for securing postage indicia on said mailer form, said postage device being secured within said housing.

7. The folder-sealer apparatus of claim 6, wherein:

said folder-sealer apparatus is configured so as to be securable to a printing device such that said mailer form is advanced from an output of said printing device to said roller assembly, and said postage device is electrically coupled to said printing device when said folder-sealer apparatus is secured to said printing device.

8. The folder-sealer apparatus of claim 7, wherein said postage device communicates with said printing device so as to cause said postage indicia to be printed on said mailer form during advancement of said mailer form through said printing device.

9. The folder-sealer apparatus of claim 7, wherein both said printing device and said postage device are electrically coupled to a computing device.

10. The folder-sealer apparatus of claim 9, wherein:

said computing device includes a personal computer, said printing device includes a laser printer, said postage device is electrically coupled to a first communication port of said personal computer, and said laser printer is electrically coupled to a second communication port of said personal computer.

11. The folder-sealer apparatus of claim 10, wherein said postage device communicates with said personal computer so as to cause said postage indicia to be printed on said mailer form during advancement of said mailer form through said laser printer.

12. An apparatus for printing, folding, and sealing a mailer form, comprising:

a printing device having a print engine; and a folder-sealer device having (i) a roller assembly for folding and sealing said mailer form, and (ii) a postage device for generating an electronic representation of postage indicia, wherein said postage device is configured to transmit said electronic representation of said postage indicia to said printing device such that said postage indicia is printed on said mailer form by said print engine when said mailer form is advanced through said print engine.

13. The apparatus of claim 12, wherein both said printing device and said postage device are electrically coupled to a computing device.

14. The apparatus of claim 13, wherein:

said computing device includes a personal computer, said printing device includes a laser printer, said postage device is electrically coupled to a first communication port of said personal computer, and said laser printer is electrically coupled to a second communication port of said personal computer.

15. The apparatus of claim 14, wherein said postage device is configured to transmit said electronic representation of said postage indicia to said personal computer so as to cause said postage indicia to be printed on said mailer form during advancement of said mailer form through said print engine of said laser printer.

* * * * *